US005651202A

United States Patent [19]

Hewitt

[11] Patent Number: 5,651,202

[45] **Date of Patent: *Jul. 29, 1997**

[54] EXPANDABLE DISPLAY DEVICE AND SPORTS CARD HOLDER

[76] Inventor: Harold O. Hewitt, 1909-21 Avenue, SW., Calgary, Alberta, Canada, T2T 0N6

[ * ] Notice: The term of this patent shall not extend beyond the expiration date of Pat. No. 5,477,631.

[21] Appl. No.: 530,508

[22] Filed: Sep. 19, 1995

Related U.S. Application Data

[63] Continuation-in-part of Ser. No. 59,976, May 13, 1993, Pat. No. 5,477,631.

[51] Int. Cl.[6] ..... G09F 7/00

[52] U.S. Cl. ..... 40/605; 40/124; 40/661; 40/600; 206/39

[58] Field of Search ..... 40/124, 124.2, 40/124.4, 706, 771, 781, 600, 605, 621, 624, 661; 206/0.82, 0.83, 0.84, 38, 39, 449, 456

[56] References Cited

U.S. PATENT DOCUMENTS

| | | | |
|---|---|---|---|
| 1,818,722 | 8/1931 | Lewis | 40/624 |
| 2,957,261 | 10/1960 | Moskowitz . | |
| 2,993,289 | 7/1961 | Miller, Jr. | 40/624 |
| 3,168,787 | 2/1965 | Surrey . | |
| 3,263,357 | 8/1966 | Carleton . | |
| 3,456,373 | 7/1969 | Epton . | |
| 3,466,126 | 9/1969 | Sakamoto . | |
| 3,753,306 | 8/1973 | Hemgren | 40/605 |
| 3,786,584 | 1/1974 | Holson . | |
| 3,826,026 | 7/1974 | Bevan . | |
| 3,852,901 | 12/1974 | Woodle | 40/605 |
| 4,251,936 | 2/1981 | Ferrell . | |
| 4,524,867 | 6/1985 | Klein | 40/661 X |
| 4,594,802 | 6/1986 | Field . | |
| 4,741,534 | 5/1988 | Rogahn . | |
| 4,829,691 | 5/1989 | Manjos et al. . | |
| 4,912,864 | 4/1990 | Price . | |
| 4,918,848 | 4/1990 | Stein . | |
| 5,010,673 | 4/1991 | Connor et al. . | |
| 5,040,671 | 8/1991 | Hager . | |
| 5,046,616 | 9/1991 | Makowski | 206/564 X |
| 5,050,834 | 9/1991 | Tardiff . | |
| 5,056,251 | 10/1991 | Connor et al. . | |
| 5,082,122 | 1/1992 | Connor, Jr. . | |
| 5,097,953 | 3/1992 | Gingras . | |
| 5,121,563 | 6/1992 | Connor . | |
| 5,133,450 | 7/1992 | Rademacher . | |
| 5,186,566 | 2/1993 | Cameron | 40/661 X |
| 5,269,083 | 12/1993 | Vampatella | 40/621 X |
| 5,344,015 | 9/1994 | Carlin et al. | 206/449 |
| 5,477,631 | 12/1995 | Hewitt | 40/605 |

FOREIGN PATENT DOCUMENTS

| | | | |
|---|---|---|---|
| 3900165 | 7/1990 | Germany | 40/661 |
| 9205534 | 4/1992 | WIPO | 40/600 |

*Primary Examiner*—Brian K. Green

*Attorney, Agent, or Firm*—Cushman Darby & Cushman Intellectual Property Group of Pillsbury Madison & Sutro, LLP

[57] ABSTRACT

A display system suitable to display and protect card-like objects. The display system includes an expandable display device and a card holder. The expandable display includes a primary backing panel and a frame assembly providing a contiguous border around a periphery of the primary backing panel. The card holder includes a transparent first panel and a transparent second panel that selectively engages the first panel to hold the card-like object. Indentations in the first and second panels at a peripheral edge thereof provide a cutout gripping portion enabling the card holder to be manually grasped by inserting a portion of a finger into the cut-out portion.

15 Claims, 18 Drawing Sheets

EXPANDABLE DISPLAY DEVICE AND SPORTS CARD HOLDER

CROSS-REFERENCE TO RELATED APPLICATION

This application is a continuation-in-part of U.S. patent application Ser. No. 08/059,976 filed on May 13, 1993, now U.S. Pat. No. 5,477,631, by the same inventor.

BACKGROUND OF THE INVENTION

1. Field of the Invention

The present invention relates to image bearing medium display devices, and in particular, to expandable display device and a card holder suitable for use in the expandable display device for displaying and protecting card-like objects.

2. Description of the Related Art

Collecting and trading image bearing memorabilia such as baseball, football, hockey cards, and the like, has long been and continues to be a popular hobby. As a result, old, rare, and unusual cards have become particularly valuable and the business of collecting and trading such cards has grown. Therefore, there is a need for a device capable of protecting the sports cards while also displaying them in an aesthetically pleasing fashion so that collectors can, for example, display their cards at home and traders can display their cards at card-trading shows and conventions. Furthermore, it is important that the sports card display system permit the interchanging of cards within the display system. Also, it is important that the display system be capable of accommodating a varying number of cards so that a collector can display cards added to his collection and/or tailor the displays to best present the cards to potential customers.

In one display system the individual cards are placed in pockets formed in a soft sheet of plastic. These sheets of plastic can then displayed on a binder or laid out on a flat surface, such as a table, at a card-trading exhibition. Such display systems, however, may not adequately protect the cards from bending and may not enable cards to be handled individually. Also, the plastic folders are not well suited to display cards on a vertical wall.

In another display system typified by U.S. Pat. Nos. 4,829,691; 5,010,673; 5,097,953; and 5,133,450, each card is individually placed within a rigid plastic holder formed from two transparent halves. It can be difficult, however, to maintain the two halves of the card holder together while keeping the card holder relatively small, lightweight, easy to handle, and aesthetically pleasing, without distracting the observer from the card within the holder or obstructing the view of the card. To display a number of such holders, the holders are typically laid on a flat surface, such as a table, in a side-by-side fashion. This arrangement, however, may not be especially aesthetically pleasing so as to attract potential customers. Also, it can be difficult and ungainly to display a number of such holders on, for example, a vertical wall, and the individual card holders can be easily be lost or stolen. Furthermore, when a solid card holder is laid on a flat surface, it can be difficult to remove the holder from the surface. This is an important consideration to traders who want potential customers to be able to handle each card and the card holder individually with ease.

In another display system, taught by U.S. Pat. No. 5,082,122, a plurality of panels are provided and can be arranged into a three-dimensional display. Each card is placed in a holder, as just discussed above. The holder is then positioned between pegs extending from the panel surface and secured thereto by caps placed over the pegs. This display system enables a number of card holders to be displayed in a group, but it may not provide an optimum presentation of the cards and may not adequately protect the cards from damage. Two panels can be perpendicularly mounted together to form three dimensional arrangements by inserting a tab, projecting in the plane of a panel, in a slot provided in the surface of another panel. However, it is not possible to use this tab and slot arrangement to secure two panels together in a side-by-side relation for increasing the display area in two dimensions.

SUMMARY OF THE INVENTION

It is an object of the present invention to provide a display device and card holder, adapted to be used in combination to define a display system, which overcomes the problems associated with the other display devices as discussed above.

In accordance with the principles of the present invention, this objective is achieved by providing a display device comprising a primary backing panel, which includes top, bottom, first, and second edge portions, for receiving thereon at least one card holder. Associated with the primary backing panel is a frame providing a contiguous border around the periphery of the primary backing panel. The frame includes at least one top frame member selectively engaging the top edge portion of the primary backing panel, at least one side frame member selectively engaging the first edge portion, at least one bottom frame member selectively engaging the bottom edge portion, and at least another side frame member selectively engaging the second edge portion of the primary backing panel. The display device also includes an assembly for selectively securing at least one card holder to the primary backing panel and/or the frame.

The card holder used in combination with the display device includes two transparent panels between which the card-like object is held. A fastening means maintains the two panels in a surface-to-surface abutting relation so that the card-like object is held between the two panels. A pair of exterior slots are provided in both panels and aligned such that the slots provide a gripping portion enabling the card holder to be easily removed from a flat surface by inserting a portion a finger into said slot. The card holder also includes a separation assembly enabling the two panels to be easily separated from one another. Additionally, the card holder includes an attachment assembly for securing the card holder to the backing panel and/or the frame.

It is a further object of the present invention to provide an expandable display device and sports card holder which are simple in construction, economical in manufacture, and effective in operation.

The present invention may best be understood with reference to the accompanying drawings wherein an illustrative embodiment of the present invention is shown.

DETAILED DESCRIPTION OF THE PRESENTLY PREFERRED EXEMPLARY EMBODIMENT

Figure 1A:
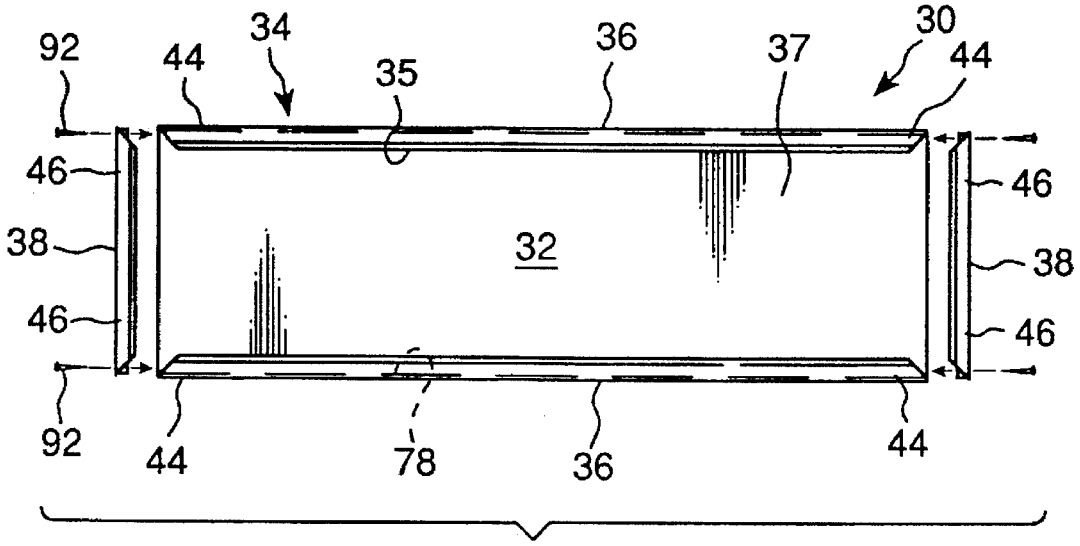
FIG. 1*a* is an exploded plan view of the expandable display device in it simplest, unexpanded form according to the principles of the present invention.
Figure 1B:
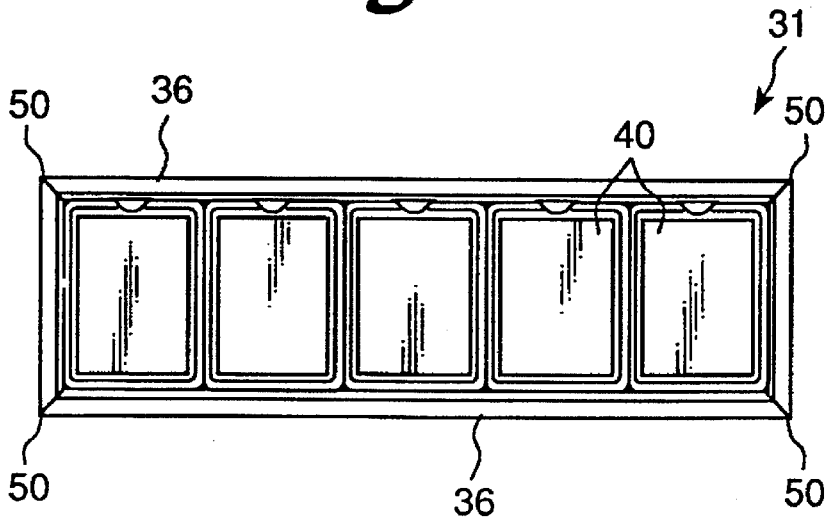
FIG. 1*b* is a plan view of the display system incorporating the display device shown in FIG. 1*a;*

Referring now, more particularly, to FIGS. 1*a*–1*b*, there is shown therein an expandable display device, generally indicated at 30, which includes a primary backing panel 32 and an frame assembly, generally indicated at 34. As shown, in its simplest, non-expanded form the frame assembly 34 includes top and bottom frame members 36. Because the top and bottom members are identical in structure, they are designated by identical reference numerals. The frame assembly 34 also includes first and second side frame members 38. Because the side members are identical in structure, they are designated by identical reference numerals. The frame members 36 and 38 are disposed around the periphery of the primary backing panel 32 and engage one another at end portions thereof to hold the primary backing panel 32 within the frame assembly 34. Once assembled, as shown in FIG. 1*b*, the backing panel 32 is secured within the frame assembly 34 so that the display device 30 can receive a plurality of card holders 40 mounted to the display surface 37 of the backing 32, thereby defining a card holding display system, generally indicated at 31. The frame assembly 34 serves as a means for gripping the display device 30 so that the display system 31 can be handled without disturbing the card holders 40. The frame assembly 34 also serves to protect the card holders 40 from damage. The card holders 40 and the elements comprising the display device 30 are sized so that a predetermined number of card holders 40 can be mounted within the frame assembly 34 such that the edges of the card holders 40 are flush with the inner periphery 35 of the frame assembly 34 to thereby display card-like objects in each card holder 40 in an orderly and aesthetically pleasing manner.

The top and bottom members 36 are sized so as to define a first dimension of the frame assembly 34 and have beveled end portions 44. The end portions 44 are referred to as inwardly beveled because the surface of the beveled ends 44 can be seen when viewing the frame members 36 from the front, see FIG. 3*a*. The side frame member 38 also have inwardly beveled end portions 46 which engage the inwardly beveled end portions 44 of the first pair of frame members 36. The surfaces of the inwardly beveled end portions 44 and 46 are adapted to be engaged in a surface-to-surface abutting relation so as to from a generally 90° angle between the two frame members 36 and 38. When assembled, the inwardly beveled end portions of the first and second pair of frame members 36 and 38 form the corners 50 of the frame assembly 34.

Figure 1C:
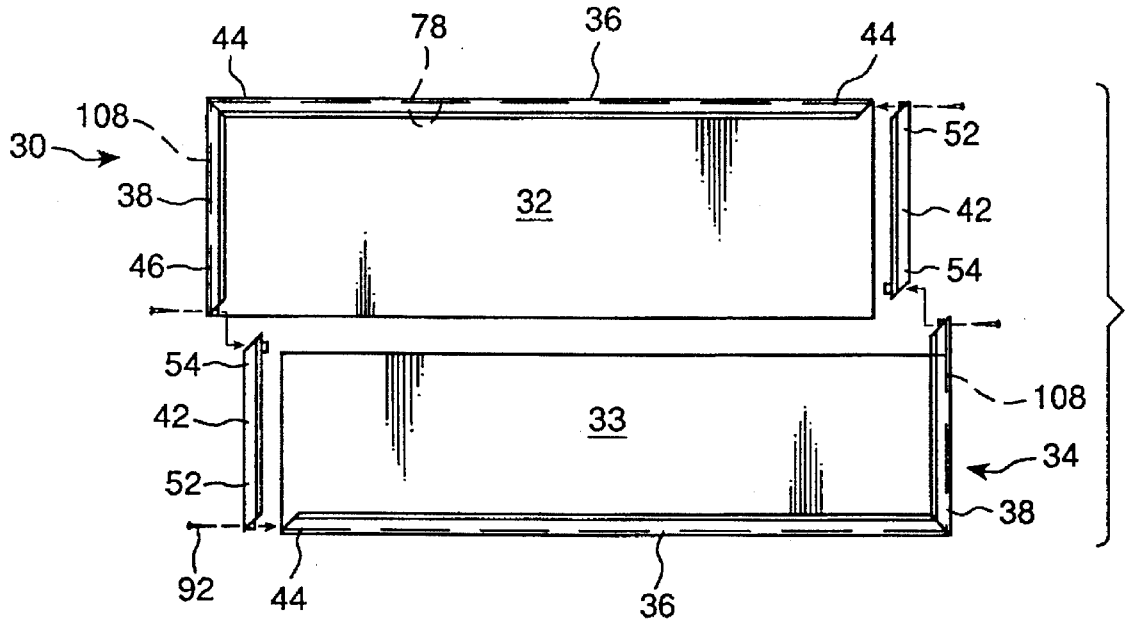
FIG. 1*c* is an exploded plan view of the display device showing the method by with the display device is expanded according to the principles of the present invention.
Figure 1D:
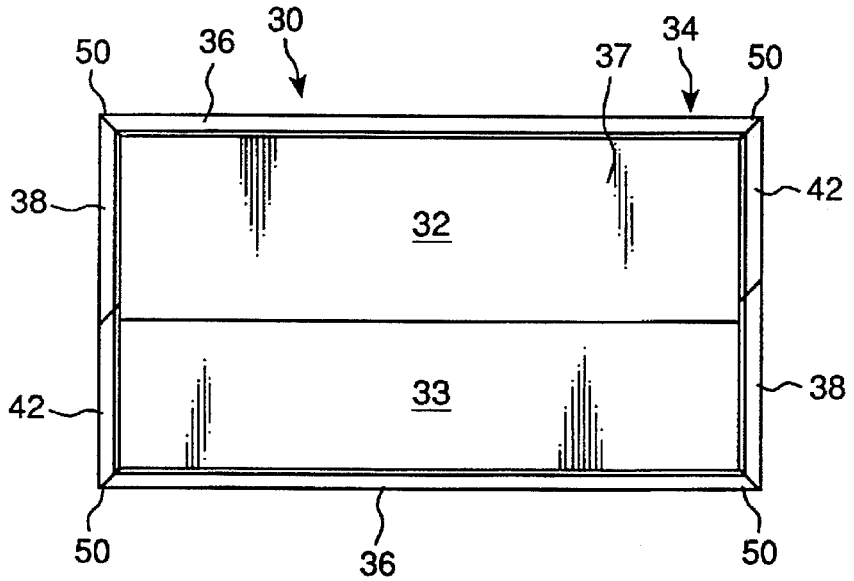
FIG. 1*d* is a plan view of the assembled display device shown in FIG. 1*c;*

As shown in FIGS. 1*c*–1*d*, the size of the display device 30, including the display surface 37 on which the card holders are mounted, can be increased by providing an expansion assembly. The expansion assembly includes an secondary backing panel 33 positioned adjacent the primary backing panel 32 for increasing the size of the display surface 37, defined by the surface of the backings 32 and 33, on with the card holders 40 are selectively mounted. The frame assembly 34 can be expanded to accommodate the secondary backing 33 within the frame assembly 34, thereby maintaining a contiguous border around the periphery of the two backings 32 and 33. Backing 33 is held in an adjacent side-by-side relation with backing 32 by the frame assembly 34.

To expand the frame assembly 34, the expansion assembly also includes two extension frame members 42, identical in structure and referred to with like numerals, positioned on opposite sides of the frame assembly 34 and coaxially aligned with the side frame members 38. Each extension frame member 42 has an inwardly beveled end portion 52 and an outwardly beveled end portion 54. As shown, the inwardly beveled end portion 52 is adapted to engage an end portion 44 of the top and bottom frame members 36 to form a corner 50 of the frame assembly 34. The outwardly beveled end portion 54 engages the inwardly beveled end portion 46 of the side frame members 38 thereby forming a coaxial joint between the extension member 42 and the side frame member 38.

Figure 1E:
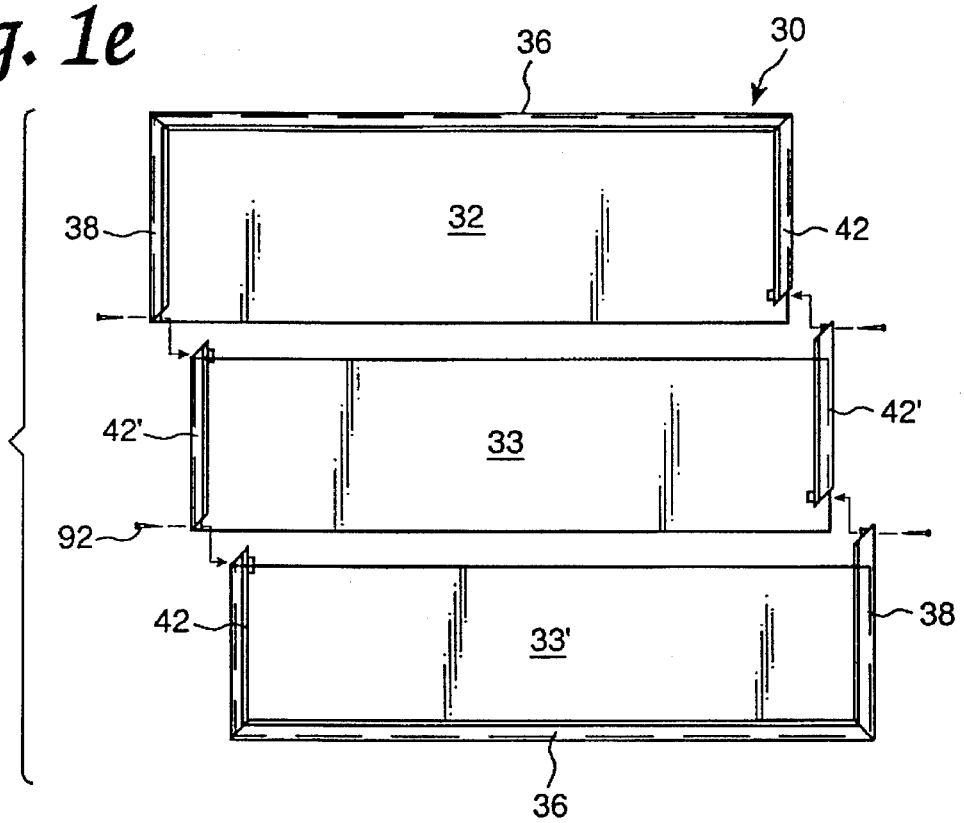
FIG. 1*e* is an exploded plan view of the display device showing further expansion of the display device.
Figure 1F:
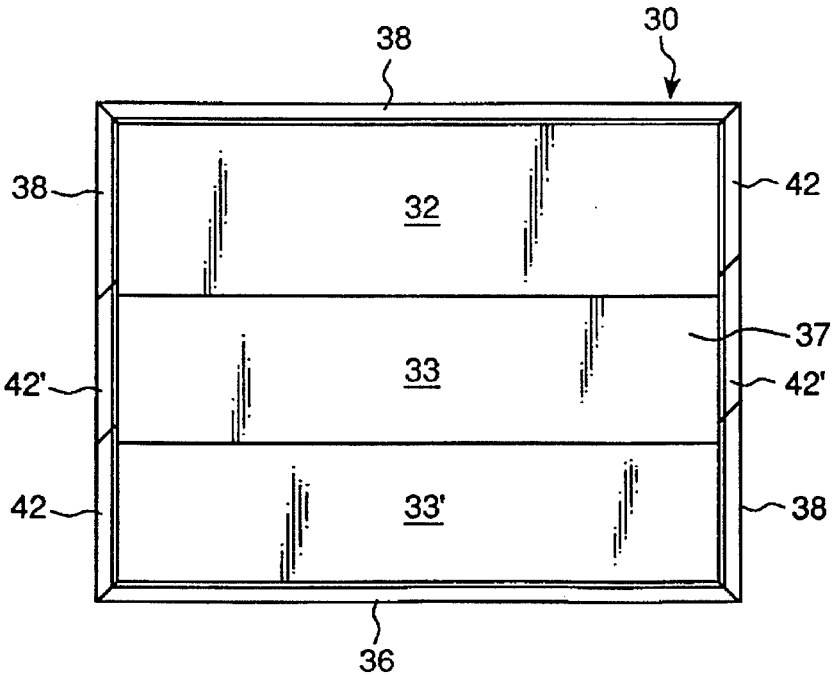
FIG. 1*f* is a plan view of the assembled display device shown in FIG. 1*e;*

As shown in FIGS. 1*e*–1*f*, the display device 30 can be still further expanded to accommodate another row of card holders (not shown). This is accomplished by using the same the parts of the expansion assembly as discussed above. Specifically, another secondary backing panel 33' can be added adjacent to the existing backings 32 and 33, thereby increasing area of the display surface 37. Additional expansion frame members 42' engaged the sides of the backing and are provided between the second pair of frame members 38 and the previously added extension members 42. The "'" indicates that the element is identical to the element having the designated numeral and is provided for ease of illustration and description. It is to be understood that the expansion frame members 42 can be provided in any position along the sides of the frame assembly 34 such that a contiguous border is provided around the periphery of the backings 32. Furthermore, all of the frame members have a channel 78 and 108 (FIGS. 1*a* and 1*c*) along the inner periphery 35 of frame assembly 34 into which edges of the backings 32 and 33 are seated so that the backings 32 and 33 are held in an adjacent side-by-side relation. The display device can continue to be expanded as desired by attaching additional expansion assemblies in a manner similar to that just described.

Figure 1G:
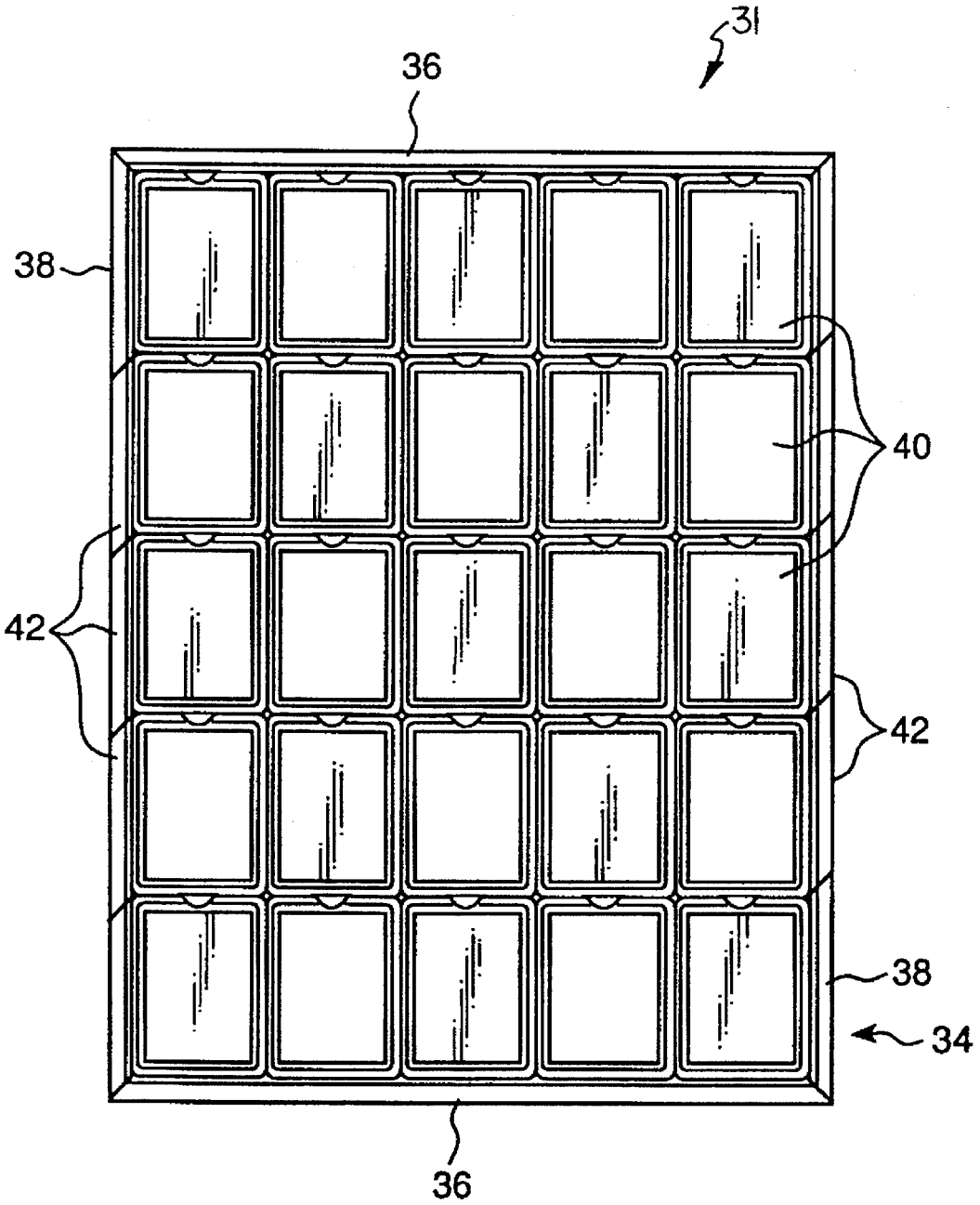
FIG. 1*g* is a plan view of a display system according to the principles of the present invention.

FIG. 1*g* illustrates a preferred arrangement of the display system 29 which includes four expansion assemblies added to the basic display device 30 (FIG. 1*a*). In this arrangement the sides of the frame assembly 34 are extended so as to be larger than the top and bottom frame members 36. A plurality of card holders 40 are mountable within the frame assembly 34 onto the backings for displaying objects in an organized and aesthetically appealing fashion. It is to be understood that the display device 30, once assembled, can be mounted on a vertical surface or laid flat, thus enabling a plurality of card holders to be displayed in a frame system wherein the size of the frame system 29 can be varied to accommodate different numbers of card holders 40.

Figure 2A:
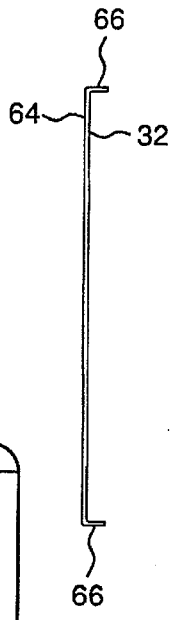
FIG. 2*a* is a plan view and FIG. 2*a*' is a side view of the first backing used in the display device of FIG. 1.
Figure 2A:
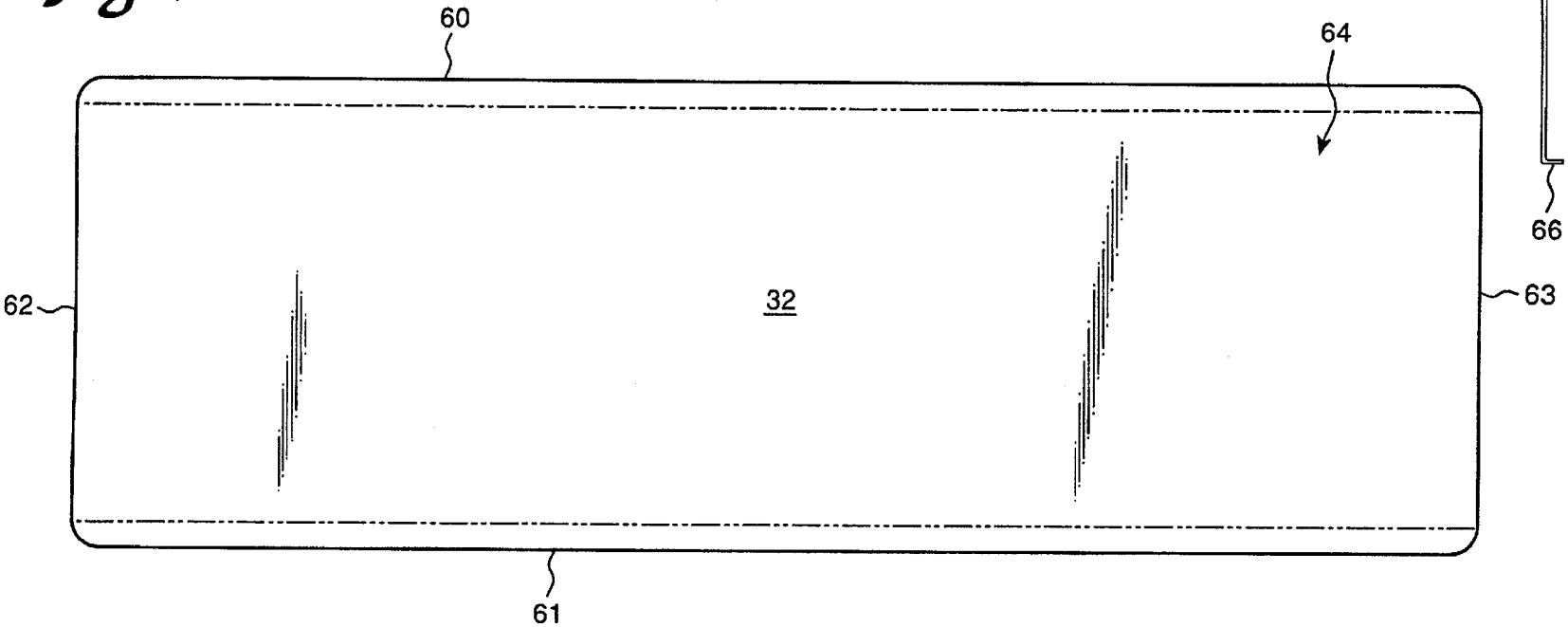
Figure 2B:
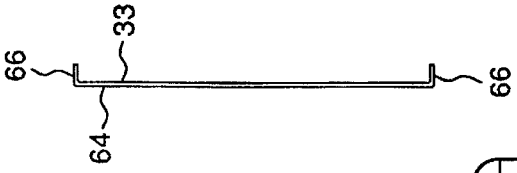
FIG. 2*b* is a plan view and FIG. 2*b*' is a side view of the second backing used in the display device of FIG. 1.
Figure 2B:
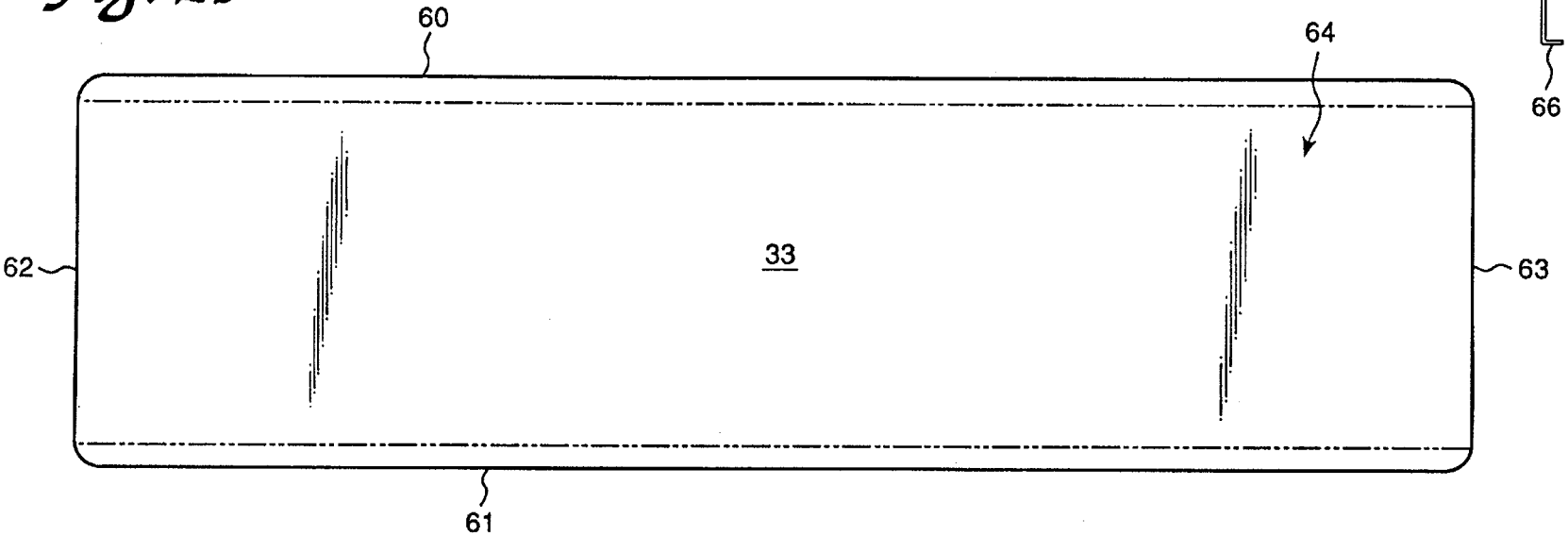

Referring now to FIGS. 2*a*–2*b*, there is shown therein the backing panels 32 and 33 used in the display device 30 of FIGS. 1*a*–1*g*. The backing panels 32 and 33 have a generally rectangular shape, top, bottom, first, and second edge portions 60, 61, 62 and 63 respectively. In an exemplary embodiment of the present invention, the edges 60 and 61 are positioned in a generally perpendicular relation with respect to front surface 64 of the backing 32 and 33 to provide rigidity in the backing. As shown, first pair of edges 60 are bent at a generally right angle away from the front surface 64 of the backing 32 and 33 to form edge flaps 66. When the backings 32 and 33 are arranged in the display device, the edge flaps 66 fit within a channel 78 in the frame members 36, and the second edges 62 fit within a channel 108 in the frame members 38 (FIGS. 1*a* and 1*c*). When additional backings 33 and 33' are added to the display device 30 of FIGS. 1*a*–1*b*, the edge flaps 66 of adjacent backings 32, 33, and 33' abut one another in a surface-to-surface relation, with the edge flaps 66 extending toward the back of the display device to thereby provide a substantially planar display surface on the front of the backings 32 and 33 on which to mount the card holders. It is to be understood that the backings 32 and 33 may additionally be held together in the abutting relation by a fastener, such as a clap or the like, between the two abutted together edge flaps 66. In an exemplary embodiment of the present invention, the backings 32 and 33 are made of metal so that the card holders can be magnetically mounted onto the backings 32 and 33. As shown in FIGS. 1*a*–1*b*, the backing 32 in the basic display device (without extensions) is sized large enough to fit within the channels of both frame members in the first pair of frame members 36. The secondary backings 33 have a slightly smaller width than the primary backing 32 in order to enable an additional row of the uniformly sized card holders 40 to be added to the expanded display device while maintaining the frame assembly 34 flush against the edges of the card holder 40. It is to be understood that two or more backings 32 and 33 could be replaced by a single larger backing.

Figure 3A:
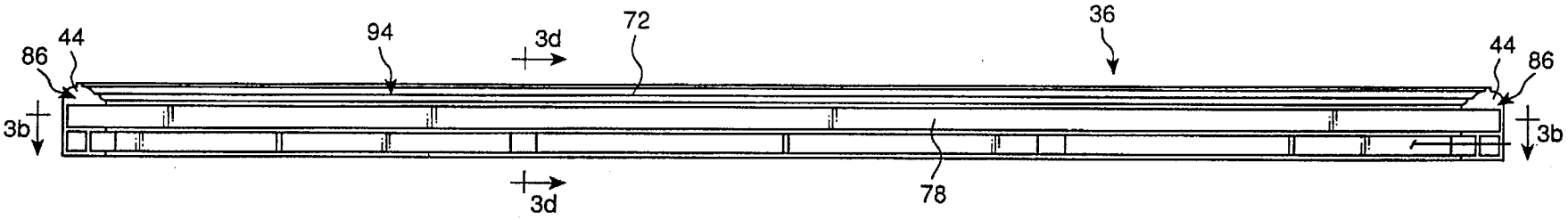
FIG. 3*a* is a front view of a frame member used in the display device shown in FIG. 1.

Referring now to FIGS. 3*a*–3*d*, there is shown therein a frame member 36 forming the top and bottom frame members 36 of the frame assembly. As shown in FIG. 3*a*, which is a front view of the frame member 36, the frame member 36 consists of a body member 72 having end portions 44. A backing receiving channel 78 extends the length of the body member 72 and is sized so as to accommodate and edge flap 66 (FIG. 2) of the backings 32 and 33 therein. To hold the backings 32 and 33 within the channel 78, a number of threaded holes 80 are provided along the length of the body member 72 between the bottom surface 82 and the channel 78 generally perpendicular to the length of the channel 78. A screw 82 or other fastening device can be threaded through each hole 80 and tightened against the back side 84 of backing panel 32 or 33, see FIG. 3*d*, to secure the backing panel 32 or 33 against a surface of the channel 78.

Figure 3B:
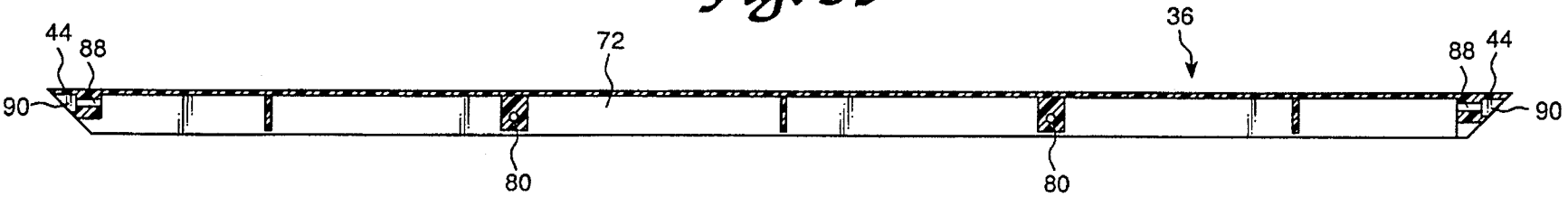
FIG. 3*b* is a sectional plan view of the frame member shown in FIG. 3*a;*
Figure 3C:
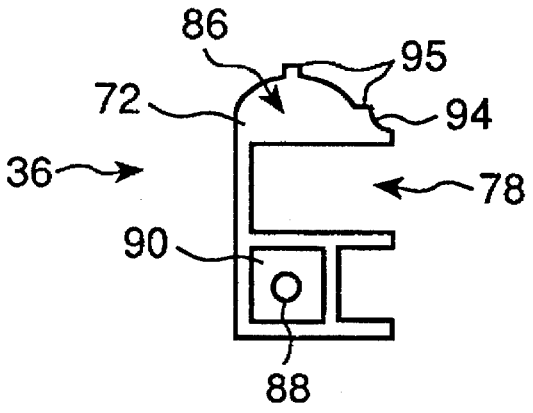
FIG. 3*c* is a side view of the frame member shown in FIG. 3*a;*
Figure 3D:
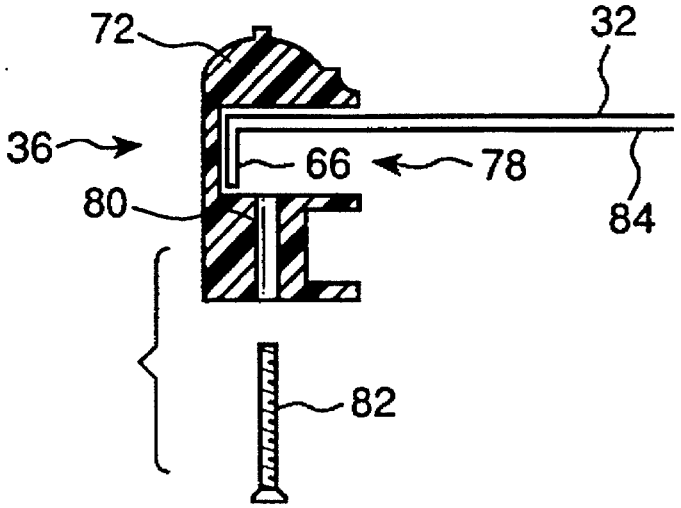
FIG. 3*d* is a sectional side view of the frame member shown in FIG. 3*a;*

As shown in FIGS. 3*a*–3*c*, the end portions 44 are inwardly beveled such that the surface 86 of the end portions 44 can be seen when viewing the frame members from the front of the body member 72. The inward bevel enables the end portions 44 to engage other inwardly beveled end portions of other frame members for forming generally right-angle corners 50 of the frame assembly 34, see FIG. 1. To secure the beveled end portions 44 to other frame member end portions (not shown), the end portions 44 include a threaded hole 88 and an alignment tab receiving receptacle, generally indicated at 90. The receptacle 90 is adapted to receive a protruding tab portion (not shown) of another frame member (not shown) therein. The two thus engaged frame members can then be secured to one another by means of a screw 92, see FIG. 1, rotatable within the threaded hole 88. The upper surface 94 of the body member 72, in an exemplary embodiment, includes ridges therein to enhance the aesthetic appearance of the display device and to enable the display device to be easily gripped and handled.

Figure 4A:
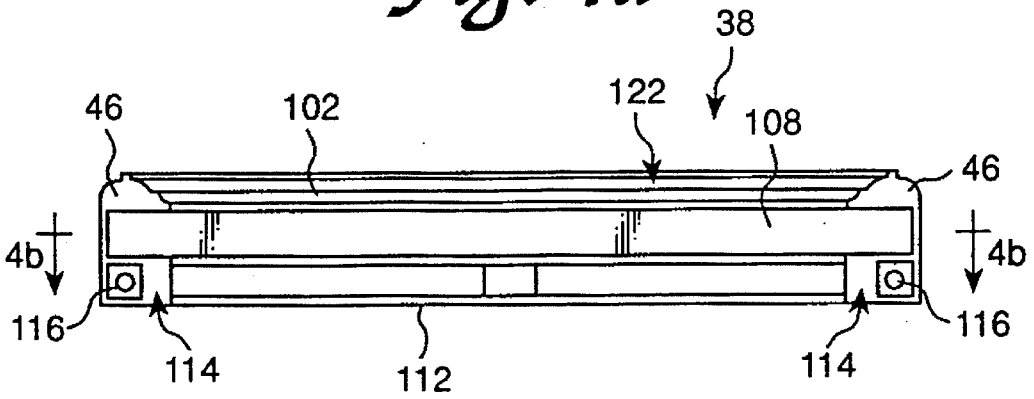
FIG. 4*a* is a front view of a second frame member used in the display device shown in FIG. 1.
Figure 4B:
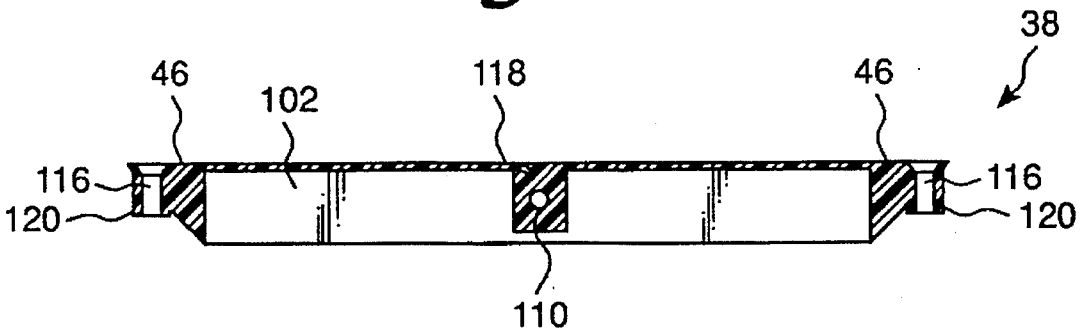
FIG. 4*b* is a sectional plan view of the second frame member shown in FIG. 4*a;*
Figure 4C:
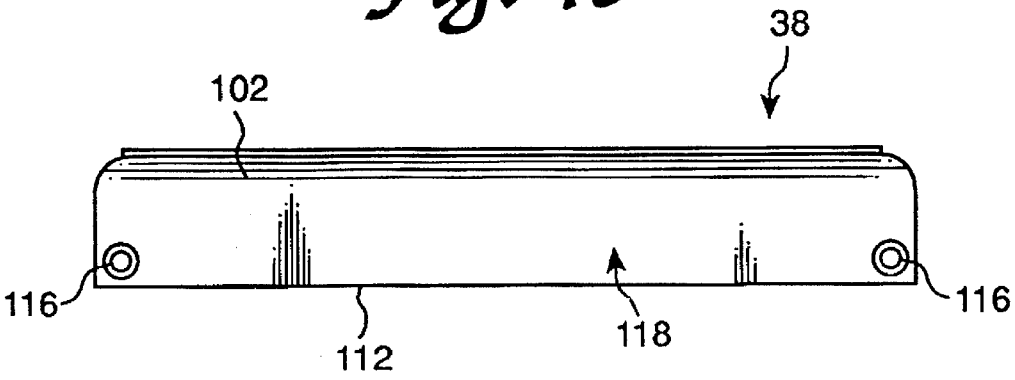
FIG. 4*c* is a back side view of the frame member shown in FIG. 4*a;*

Referring now to FIGS. 4a–4c, there is shown therein a frame member 38 in the pair of side frame members 38 of FIG. 1a. As shown in FIG. 4a, which is a front view of the frame member 38, the frame member 38 includes a body portion 102 having end portions 46. A backing receiving channel 108 extends the length of the body 102 and is sized so as to accommodate an edge 62 or 63 of the backing panel 32 and 33 (FIGS. 2a–2b) therein. To hold the backing (not shown) within the channel 108, at least one threaded hole 110 is provided along the length of the body member 102. The hole 110 enables a screw (not shown) to be threaded from the bottom surface 112 of the body member 102 into the channel 108 in a direction generally perpendicular to the length of the channel 108. The screw (not shown) maintains the backing in the channel in the same manner as discussed previously with respect to FIG. 3.

As shown in FIGS. 4a–4c, the end portions 46 are inwardly beveled such that the surface 114 of the end portions 46 can be seen when the frame member 38 is viewed from the front of the body member 102. The inward bevel enables the end portions 46 of the frame member 38 to engage other frame members end portions (not shown) to thereby form corners 50 of the display device 34, (FIG. 1a–1b). As shown in FIGS. 4a–4c, the end portions 46 include holes 116 therethrough. The holes 116 extend from the rear surface 118 of the body member 102 to the surface 114 of the beveled end portion 46. A screw 92 (FIG. 1) can then be passed through the hole 116 and threaded into a threaded hole (not shown) in another frame member (not shown) to thereby secure two frame members together at their end portions. As shown, each end portion 46 includes an alignment tab 120 protruding from the surface 114. The tabs 120 are adapted to be fitted into tab receptacles 90 (FIG. 3) to facilitate assembly of the frame assembly 34 and to strengthen the joint formed by engagement of two end portions. The upper surface 122 of the body 102 includes ridges thereon to enhance the aesthetic appearance of the display device and to enable the display device to be easily gripped and handled.

Figure 5A:
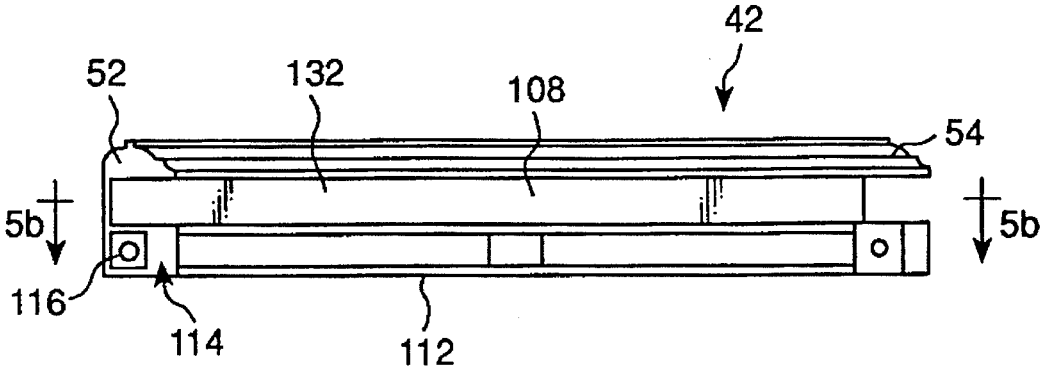
FIG. 5*a* is a front view of an extension frame member used in the display unit shown in FIG. 1.
Figure 5B:
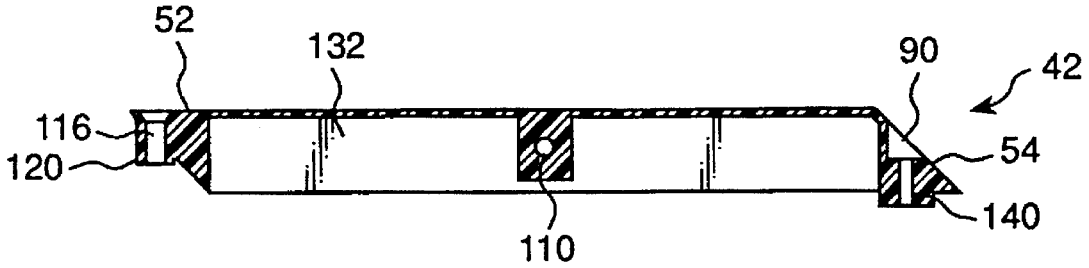
FIG. 5*b* is a sectional plan view of the extension frame member shown in FIG. 5*a;*
Figure 5C:
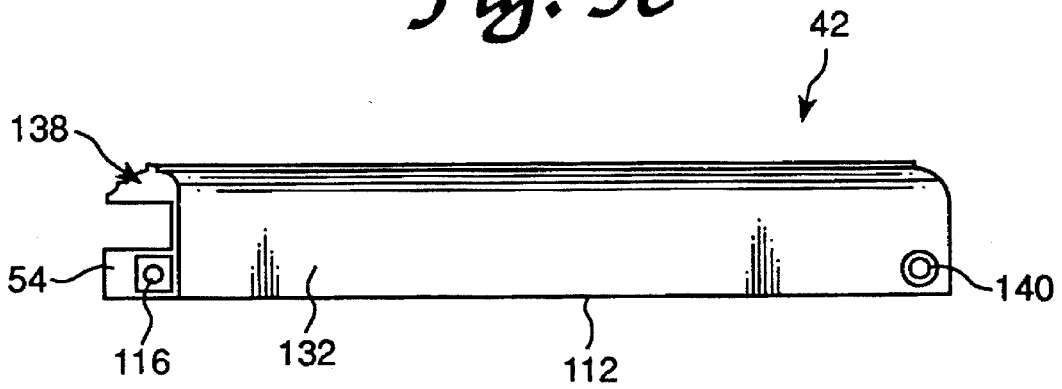
FIG. 5*c* is a back side view of the extension frame member shown in FIG. 5*a;*

Referring now to FIGS. 5a–5c, there is shown therein an extension frame member 42, which consists of a body member 132 having first and second end portions 52 and 54. The extension frame member 42 is identical in structure to the frame member 38 (FIG. 4) except that the second end portion 54 is outwardly beveled such that the surface 138 of the second end portion 54 can be seen by viewing the body member 132 from the rear (FIG. 5c). The outwardly beveled second end portion 54, when engaged with an inwardly beveled end portion of another frame member, as seen in FIG. 1, enables the extension frame member 42 to be coaxially attached to another frame member to thereby form a substantially straight joint therebetween. For example, the surface 138 of the outwardly beveled end portion 54 is capable of engaging the surface 114 of an end portion 46 of the frame member 38 as shown in FIG. 4. In such an arrangement, the frame members 42 and 38 are positioned such that the surfaces 102 and channels 108 are aligned with one another.

Referring again to FIGS. 5a–5c, the second end portion 54 is secured to another inwardly beveled end portion (not shown) by providing a threaded hole 140 into which a screw 92 (FIG. 1) is provided for securing the two end portions together. The second end portion 54 also includes an alignment tab receiving receptacle, generally indicated at 90, which is identical to the receptacle 90 on the end portions 44 of the frame member 36 of FIG. 3. The receptacle 90 receives a tab portion (not shown) from another frame member (not shown) to facilitate assembly of the display device and to form a strong joint between and portions of the two adjacent engaging frame members.

While the preferred embodiment shows the display device 34 expandable in a one direction, it is to be understood that additional frame members may be provided so as to expand the display device in a second direction. For example, the first pair of frame members 36 could include a beveled end portion arrangement that enables additional frame member to be added thereto. Furthermore, it is contemplated by the present invention that the display device could be expanded in both the first and second directions by attaching additional backings and frame members to the first and second pair of opposing frame members 36 and 38 of the display device 30. While the present invention has been described above in terms of adding frame members and backings to increase the size of the display device, it is to be understood that the additional frame members and backings could also be removed from the display device 30 to thereby decrease the size of the display device 30.

Figure 6:
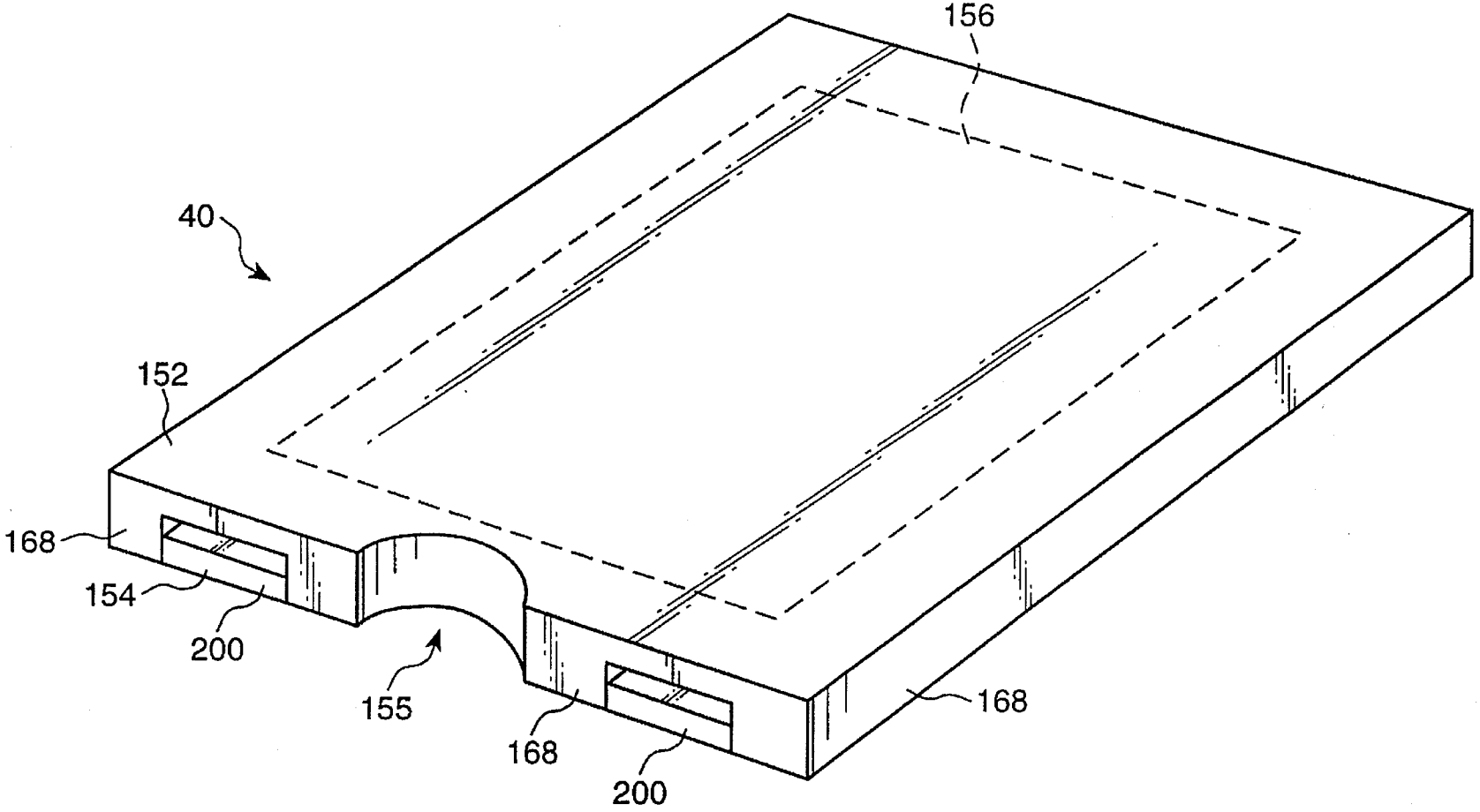
FIG. 6. is a perspective view of a sports card holder according to the principles of the present invention.

Referring now to FIG. 6, there is shown therein a card holder 40 suitable for use with the above-described display device 30 to thereby define a display system 31 (see FIG. 1b) for displaying card-like objects 156, such as baseball, football, an hockey cards, or the like. The card holder 40 includes a first transparent panel 152 and a second transparent panel 154 engaging one another such that the card-like object 156 is held between the two panels 152 and 154. First and second panels 152 and 154 are sized and shaped so that one panel fits within the other. In the illustrated embodiment, first panel 152 is sized so as to encompass second panel 154 therein, thereby forming a unitary card holding device 40 when so engaged.

Figure 7B:
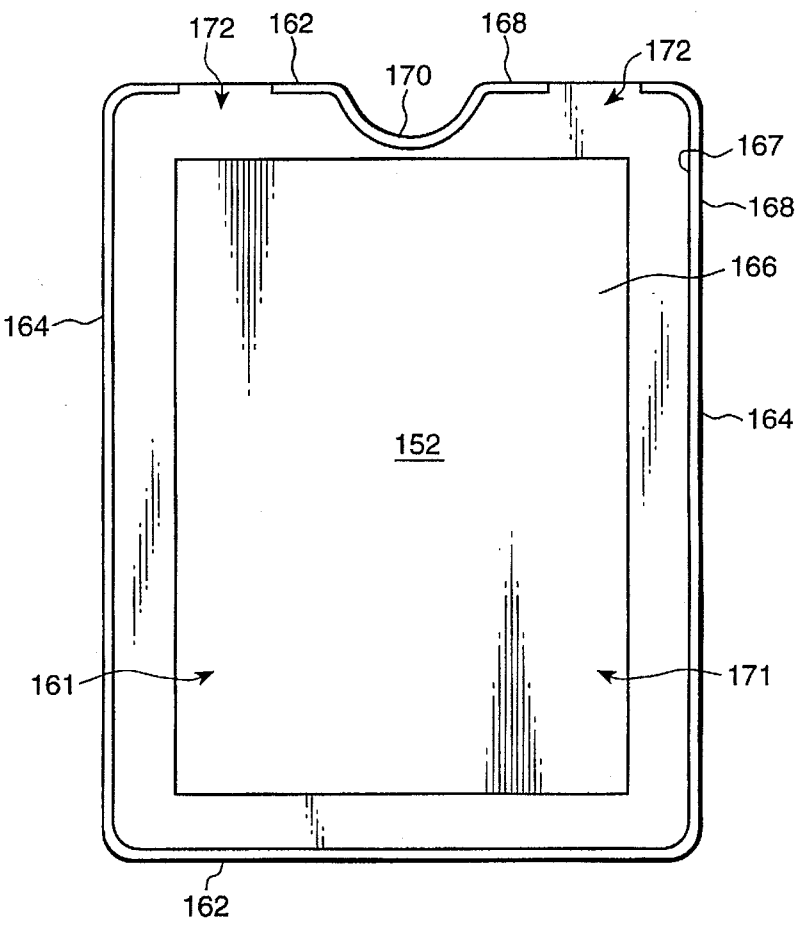
FIG. 7*b* is a plan view of the interior surface of the first panel shown in FIG. 7*a;*
Figure 7A:
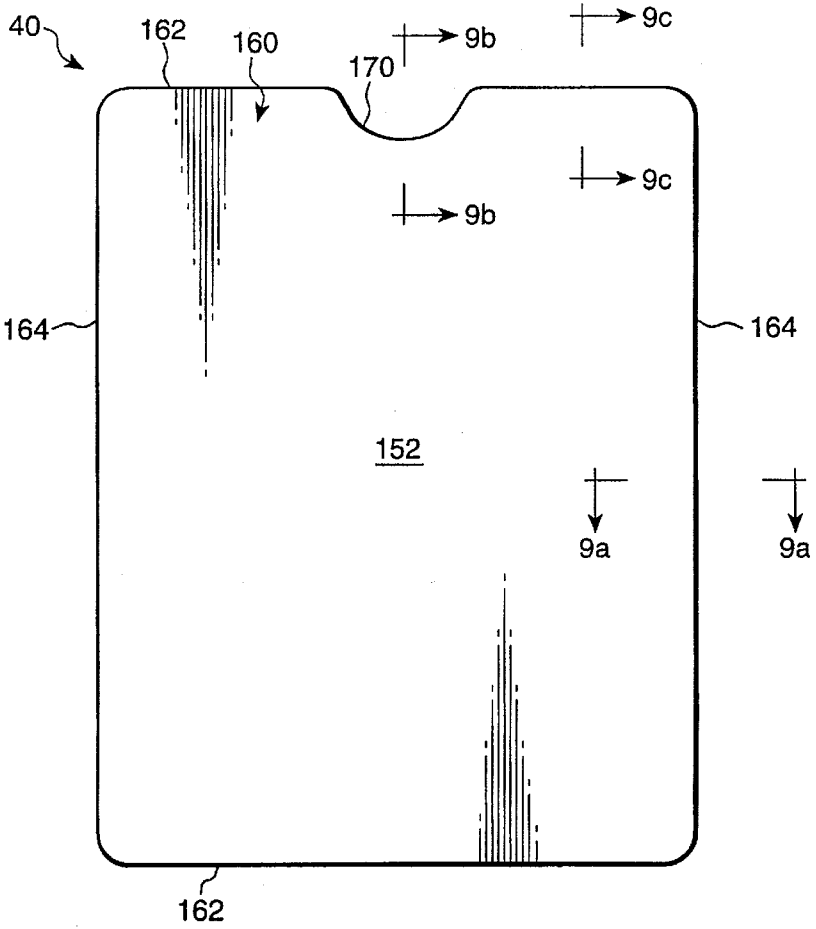
FIG. 7*a* is a plan view of a the sports card holder shown in FIG. 6 showing the exterior surface of the first panel of the sports card holder shown in FIG. 6.

Referring now to FIG. 7a, there is illustrated a plan view of card holder 40 showing the exterior surface of the first panel 152. FIG. 7b illustrates the interior surface of the first panel 152. As shown in these figures, the first panel 152 includes an exterior surface 160, an interior surface 161, a first pair of opposing edges 162, and a second pair of opposing edges 164. The interior surface 161 includes a protruding portion 166 sized so as to maintain a card-type object in a corresponding recess in the second panel 154.

First panel 152 has a protruding ridge 168 extending generally parallel from the interior surface 161 and disposed along the periphery thereof. Protruding ridge 168 is generally parallel to and provided along edges 162 and 164. The interior surface 167 of ridge 168 defines a panel receiving space 171 therein for receiving the second panel 154 so that the first panel 152 encompasses the second panel 154 when the panels are assembled. See FIG. 9a.

The height of ridge 168 is such that a distal surface 169 of the ridge 168 is substantially flush with exposed surface 180 of the second panel 154 when the first panel 152 and the second panel 154 are assembled. See FIG. 9a. As a result, when first panel 152 and second panel 154 are in an assembled relation, a unitary surface is defined along the periphery of card holder 40.

The upper portion of first panel 152 has a slot 170 therein which extends from the edge 162 toward the center of the first panel 152. Slot 170 is sized to as to enable a person to insert of a portion of a finger into the slot 170 to thereby make it easier to grasp the card holder 40 and remove to it from a flat surface, such as the display surface 37 of the display device 30 (see FIG. 1d). The portion of ridge 168 at upper edge 162 of first panel 152 includes a pair of discontinuities 172 on opposite sides of slot 170. The discontinuities create a space at the edge of the panel for receiving a protruding portion of second panel 154. Otherwise, ridge 168 extends along the entire periphery of first panel 152.

Figure 8B:
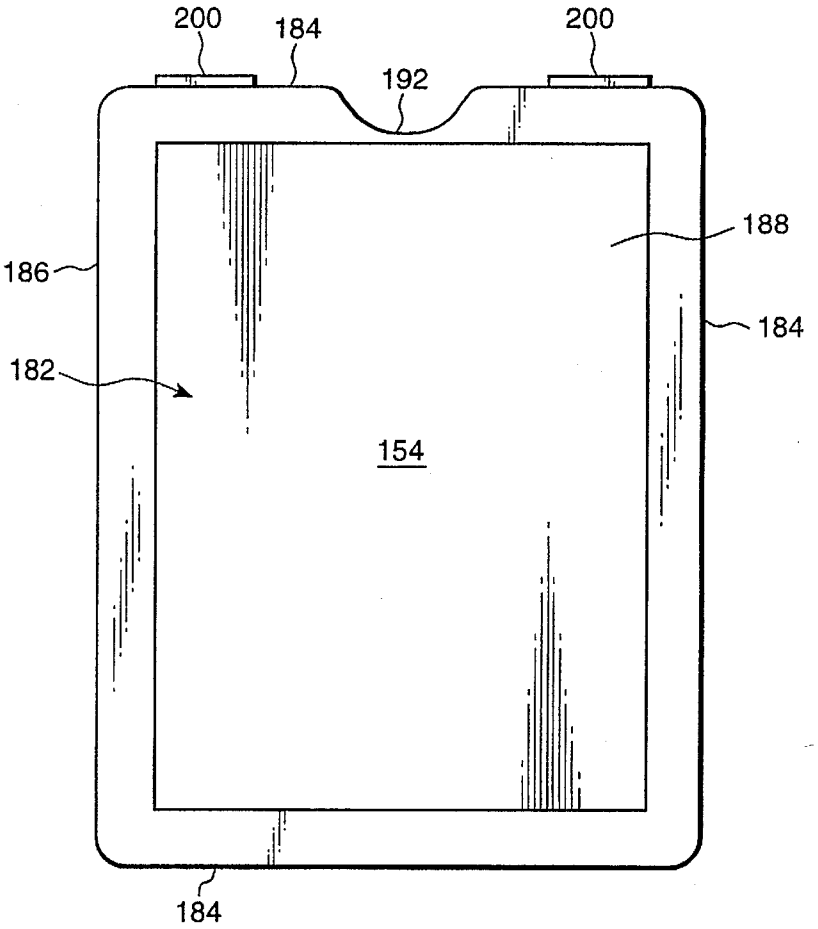
FIG. 8*b* is a plan view of the interior surface of the second panel of the sports card holder shown in FIG. 8*a;*
Figure 8A:
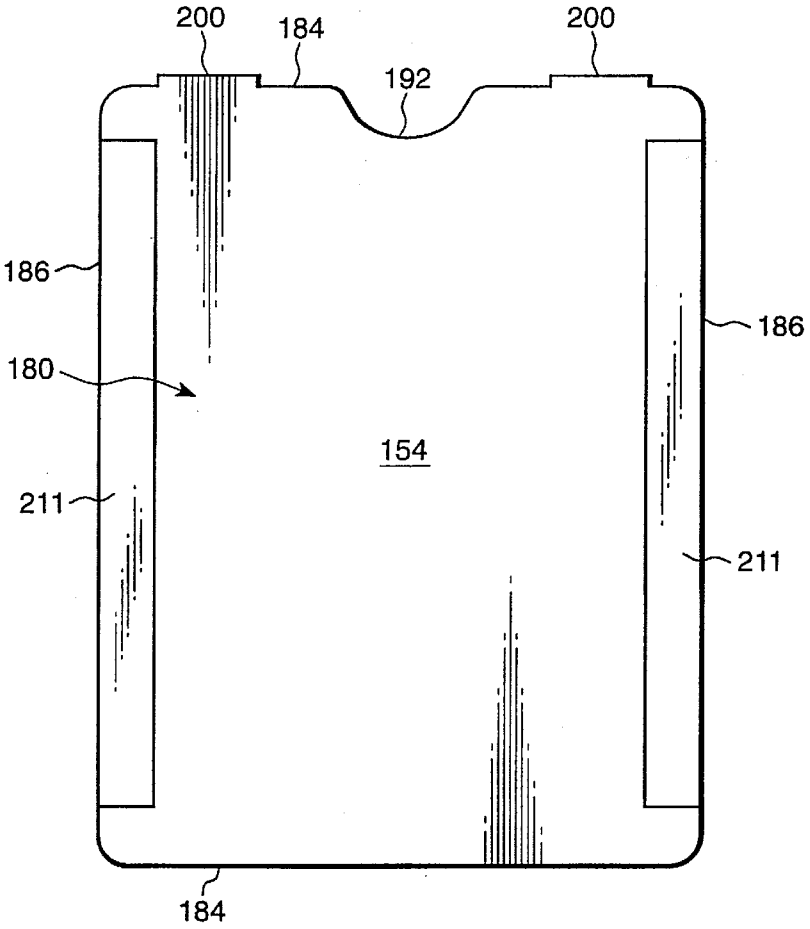
FIG. 8*a* is a plan view of the exposed surface of the second panel of the sports card holder shown in FIG. 6.

Referring now to FIGS. 8*a*–8*b*, there is shown therein the transparent second panel 154 of the card holder 40. As shown, the second panel 154 includes an exterior surface 180, an interior surface 182, a first pair of opposing edges 184, and a second pair of opposing edges 186. The interior surface 182, which engages the interior surface 161 of the first panel 152, includes a recessed portion 188 that cooperates with the protruding portion 166 of the first panel 152 such that the surface of the recessed portion 166 and the surface of the protruding portion 188 are spaced a distance apart generally equal to the thickness of the card-type object when the first and second panels 152 and 154 are engaged. The protruding portion 166 serves to maintain the card-like object within the recessed portion 188.

Figure 9A:
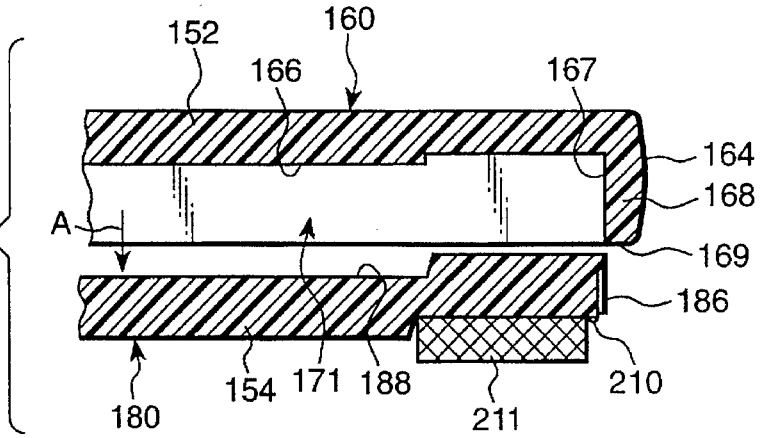
FIG. 9*a* is a partial cross-sectional view of the sports card holder shown in FIG. 7*a* taken along lines 9*a*—9*a* in FIG. 7*a* showing the engaging relationship of the first and second panels.
Figure 9B:
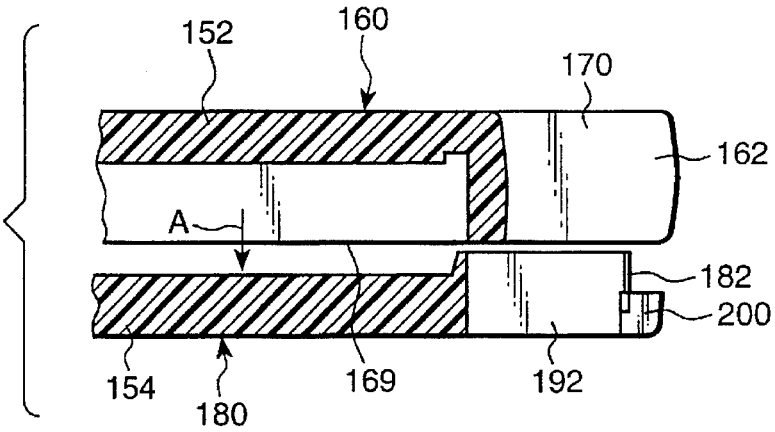
FIG. 9*b* is a partial cross-sectional view of the sports card holder shown in FIG. 7*a* taken along lines 9*b*—9*b* in FIG. 7*a;*

The second panel 154 is sized relative to the first panel 152 such that the edge portions 184 and 186 fit within protruding ridge 168. FIG. 9*a*, for example, shows the relationship between the edge portion 186 of the second panel 154 and the inside surface 167 of ridge 168 at edge portion 164 of first panel 152. In this figure, the card holder is assembled, for example, by moving the first panel 152 in the direction of arrow A. Edge portions 184 and 186 engage the inside surfaces of protruding ridge 168 in the first panel 152 thereby holding the first and second panels 152 and 154 together due to the pressure and friction between the edge portions of the second panel and the inside surfaces of the ridge 168.

The upper edge portion of the second panel 154 has a slot 192 therein extending from the edge 184 toward the center of the second panel 154. The slot 192 is sized so as to match the slot 170 in the first panel 152 to make gripping the card holder easier, especially when removing the card holder 100 from a flat surface, such as the backing panels 32 and 33 of FIGS. 1–3. A shown in FIGS. 6, 7*a*–7*b*, 8*a*–8*b* and 9*b*, slot 170 extends entirely through the thickness of the first panel 152 and slot 192 extends entirely through the thickness of the second panel 154. When the first and second panels 152 and 154 are in an assembled relationship, slot 170 in the first panel 152 is positioned adjacent slot 192 in the second panel 154 so as to define a cut-out portion 155 in a peripheral edge of card holder 40; the cut-out portion 155 extending through the thickness of card holder 40 thereby providing a gripping portion enabling card holder 40 to be manually grasped by inserting a portion of a finger into cut-out portion 155. See FIG. 6.

Figure 9C:
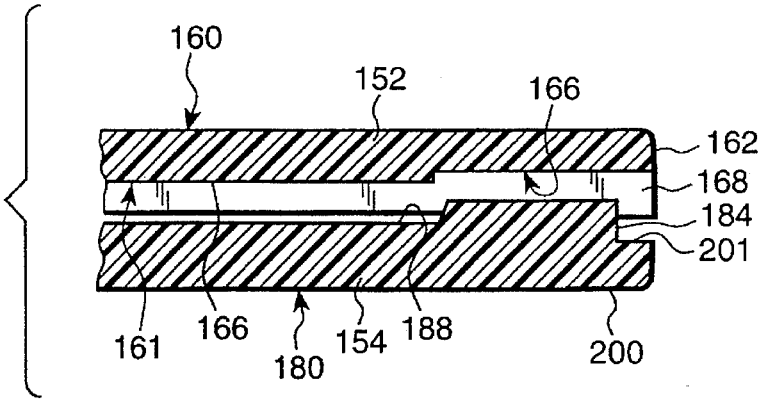
FIG. 9*c* is a partial cross-sectional view of the sports card holder shown in FIG. 7*a* taken along lines 9*c*—9*c* in FIG. 7*a;*

Referring to FIGS. 8*a*–8*b* and 9*c*, the upper edge 184 of second panel 154 also includes a pair of protruding portions 200 on opposite sides of the slot 192. As shown in FIGS. 6 and 9*c*, protruding portions 200 are positioned within the space created by the discontinuities in ridge 168 in first panel 152 when the two panels 152 and 154 are together. More specifically, the thickness of protruding portion 200 is less than the height of ridge 168 so that a gap is provided between the interior surface 201 of protruding portion 200 and the interior surface 166 of first panel 152. This gap facilitates separation of the two panels 152 and 154, which is accomplished by placing an object, such as a coin or the like, into the gap and prying the two panels part.

Referring to FIG. 9*a*, the second panel 154 includes a pair of grooves 210 on the exposed surface 180 thereof. Grooves 210 are provided to accommodate magnetic strips 211 therein, which are affixed within the grooves by any conventional method, such as glue or the like. See FIG. 8*a*. The magnetic strips 211 enable card holder 40 to be magnetically mounted to the metal backing panels 32 and 33 shown in FIGS. 2*a*–2*b*.

It is to be understood that while the preferred embodiment of the card holder according to the principles of the present invention has been described above, it is contemplated that the various features, such as the pair of slots 170 and 192 and the discontinuities and protruding portions 172 and 200 may be provided at various locations of the first and second panels 152 and 154 other than those described above and illustrated in the Figures.

Figure 10:
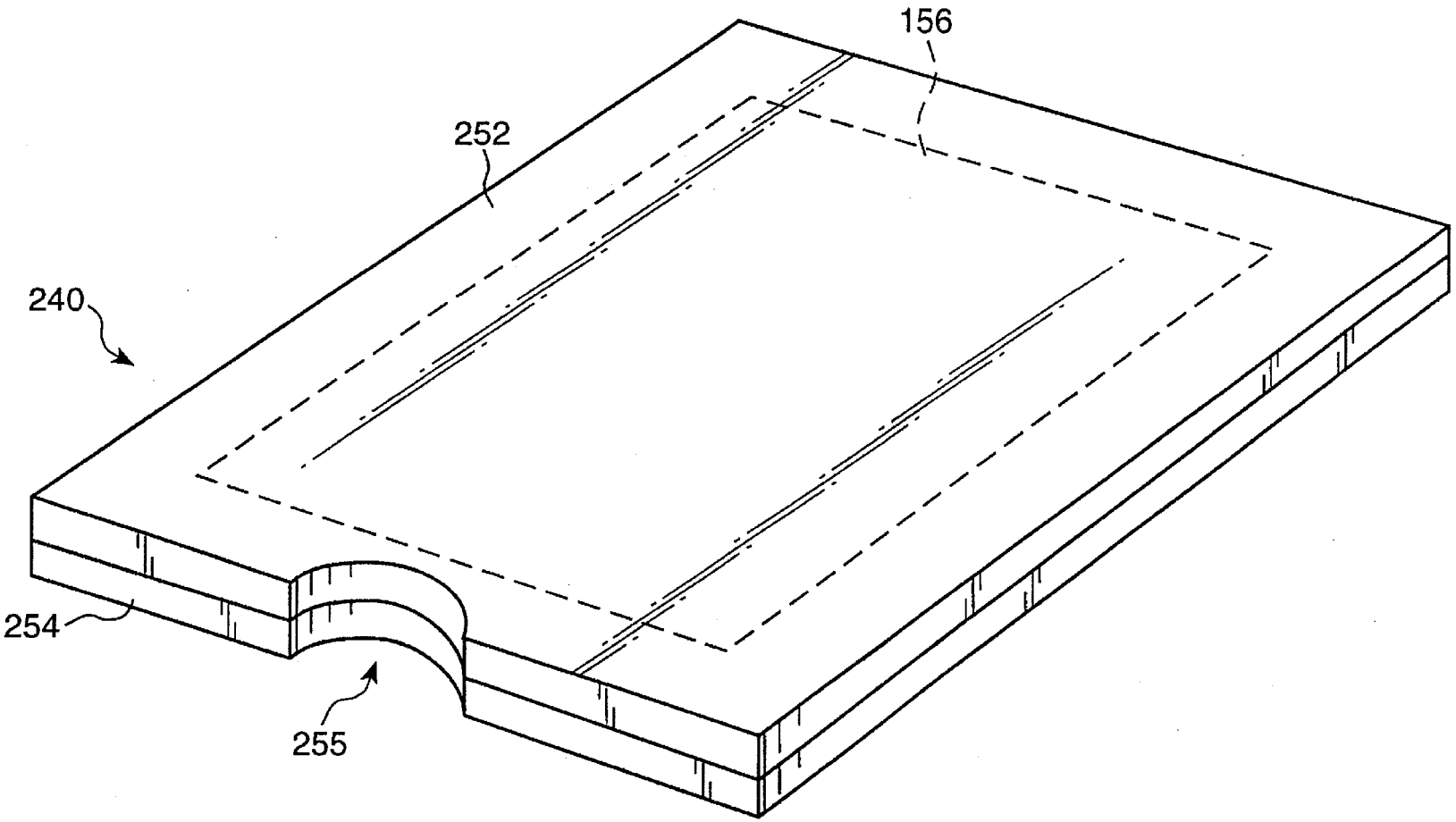
FIG. 10 is a perspective view of a sports card holder according to a second embodiment of the present invention.

Referring now to FIG. 10, there is shown therein a second embodiment of a card holder 240 suitable for use with the above-described display device 30 to thereby define a display system 31 (FIG. 1*b*) for displaying card-like objects 156, such as baseball, football, an hockey cards, or the like. The card holder 240 includes a first transparent panel 252 and a second transparent panel 254 engaging one another such that the card-like object 156 is held between the two panels 252 and 254. First and second panels 252 and 254 have similar sizes and shapes so that they match one another to form a unitary card holding device 240 when so engaged.

Figure 11B:
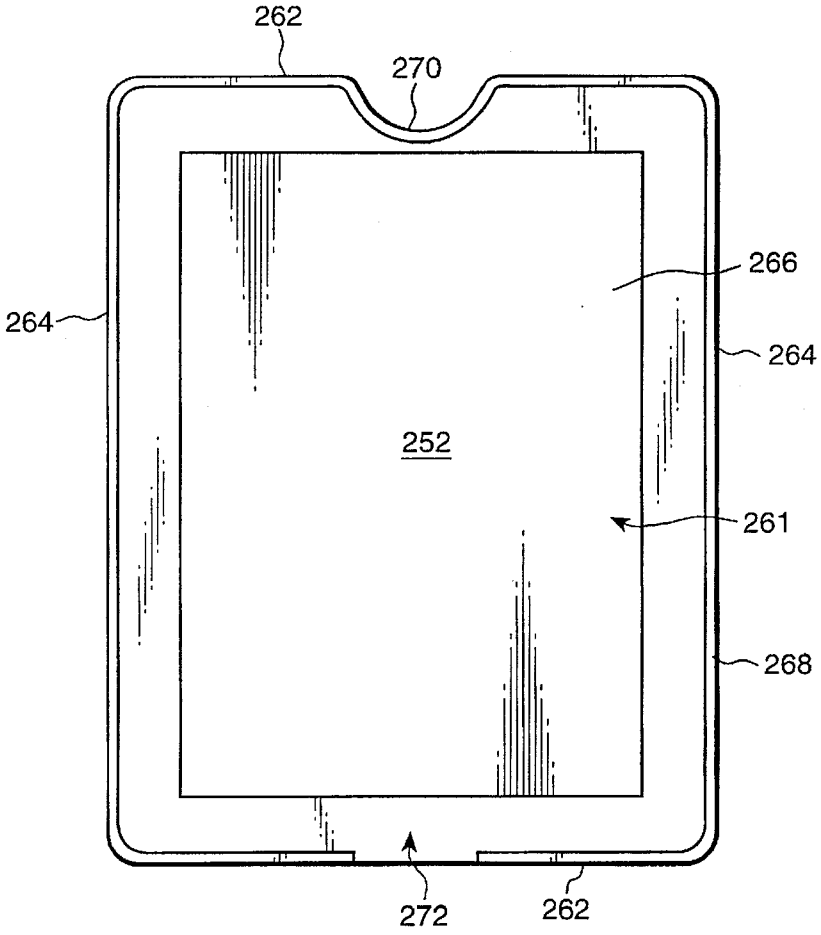
FIG. 11*b* is a plan view of the interior surface of the first panel shown in FIG. 7*a;*
Figure 11A:
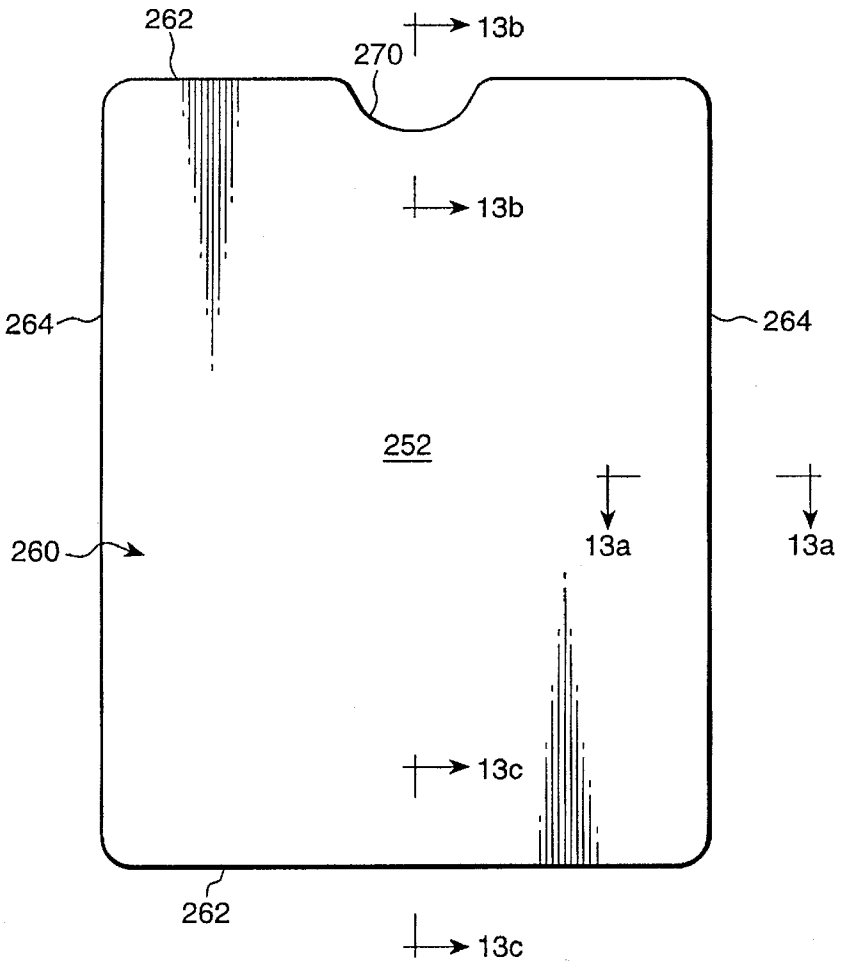
FIG. 11*a* is a plan view of a the sports card holder shown in FIG. 10 showing the exterior surface of the first panel of the sports card holder shown in FIG. 10.

Referring now to FIG. 11*a*, there is illustrated a plan view of card holder 240 showing the exterior surface of the first panel 252. FIG. 11*b* illustrates the interior surface of the first panel 252. As shown in these figures, first panel 252 includes an exterior surface 260, an interior surface 261, a first pair of opposing edges 162, and a second pair of opposing edges 264. The interior surface 261 includes a protruding portion 266 sized so as to maintain a card-type object in a corresponding recess in second panel 254.

The upper portion of the first panel 252 has a slot 270 therein which extends from the edge 264 toward the center of the first panel 252. Slot 270 is sized to as to enable a person to insert of a portion of a finger into the slot 270 to thereby make it easier to grasp the card holder 240 and remove to it from a flat surface, such as the display surface 37 of the display device 30 (see FIG. 1*d*).

First panel 252 has a protruding ridge 268 extending generally parallel from an interior surface 261 and disposed along the periphery thereof. Protruding ridge 268 is generally parallel to and provided along edges 262 and 264. The portion of ridge 268 at lower edge 262 of first panel 252 includes a discontinuity 272. Otherwise, ridge 268 extends along the entire periphery of first panel 252. As discussed in greater detail below, this discontinuity provides a mechanism for separating the assembled panel from one another.

Figure 12B:
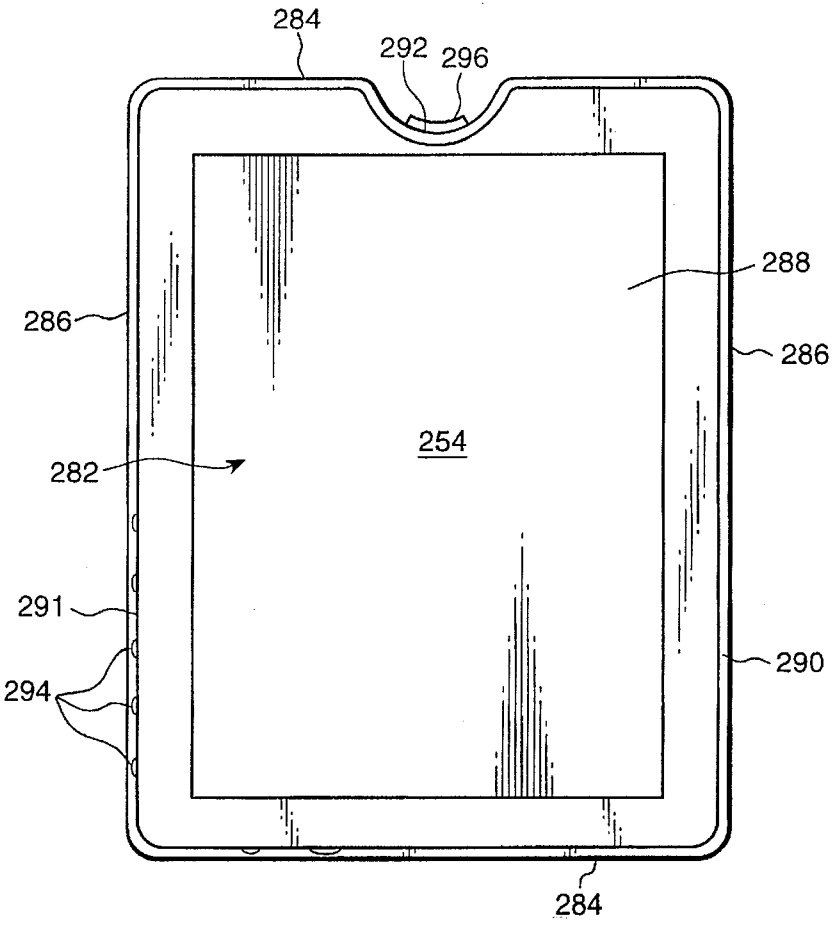
FIG. 12*b* is a plan view of the interior surface of the second panel of the sports card holder shown in FIG. 11*a;*
Figure 12A:
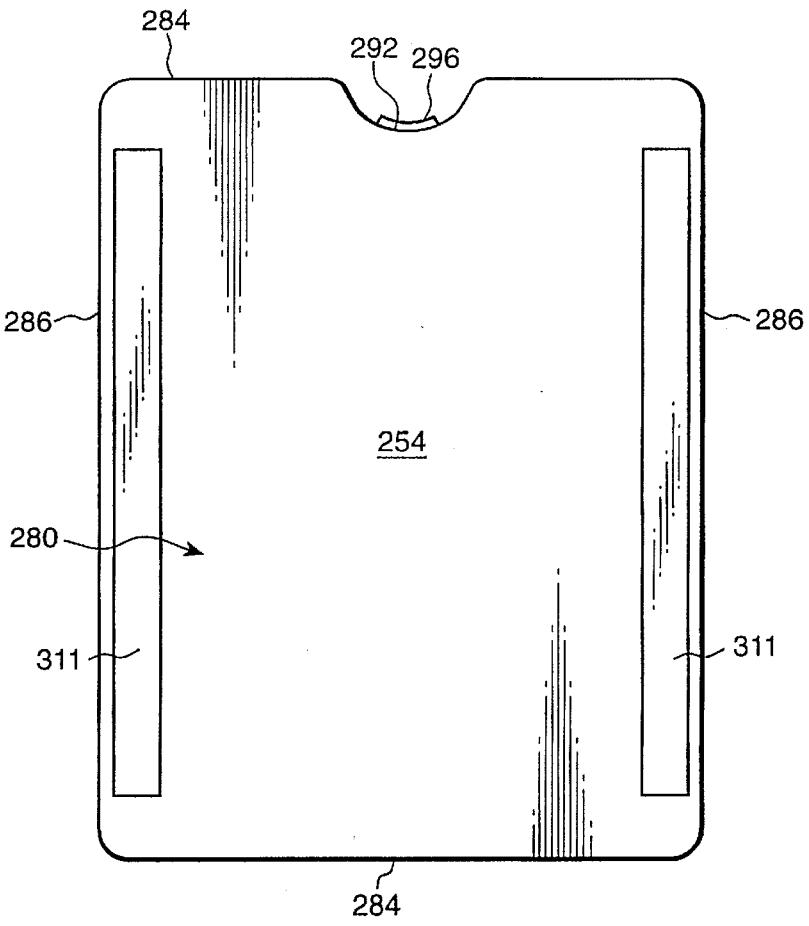
FIG. 12*a* is a plan view of the exposed surface of the second panel of the sports card holder shown in FIG. 10.

Referring now to FIGS. 12*a*–12*b*, there is shown therein the second transparent panel 254 of the card holder 240. As shown, the second panel 254 includes an exterior surface 280, an interior surface 282, a first pair of opposing edges 284, and a second pair of opposing edges 286. The interior surface 282, which engages the interior surface 261 of the first panel 252, includes a recessed portion 288 that cooperates with the protruding portion 266 of the first panel 252 such that the surface of the protruding portion 266 and the surface of the recessed portion 288 are spaced a distance apart generally equal to the thickness of the card-type object when the first and second panels 252 and 254 are engaged. The protruding portion 266 serves to maintain the card-like object within the recessed portion 288.

The second panel 254 includes a channel 290 in the interior surface 282 disposed adjacent to edges 284 and 286. Channel 290 parallels the edges 284 and 286 of second panel 254. Channel 290 receives ridge 268 therein when the first and second panels 252 and 254 are assembled.

The second panel 254 is sized relative to the first panel 252 such that edge portions 284 and 286 of second panel 254 are substantially flush with edge portions 262 and 264 of first panel 252. FIG. 9*a*, for example, shows the relationship between edge portion 286 of second panel 254 and the edge portion 264 of first panel 252.

Figure 13A:
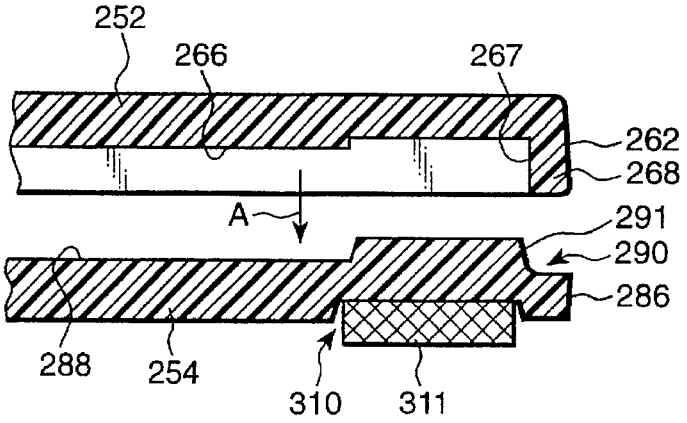
FIG. 13*a* is a partial cross-sectional view of the sports card holder shown in FIG. 11*a* taken along lines 13*a*—13*a* in FIG. 11*a* showing the engaging relationship of the first and second panels.
Figure 13B:
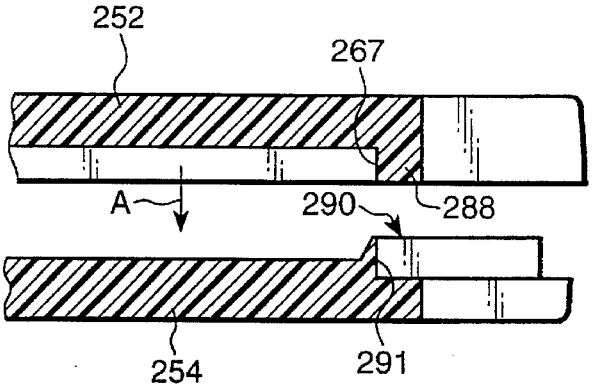
FIG. 13*b* is a partial cross-sectional view of the sports card holder shown in FIG. 11*a* taken along lines 13*b*—13*b* in FIG. 11*a*.

As shown in FIGS. 13*a*–13*b*, surface 291 of channel 290 engages the inside surfaces 267 of protruding ridge 268 in the first panel 252 thereby holding the first and second panels 252 and 254 together due to the pressure and friction between the surface 291 of channel 290 in the second panel and the inside surfaces 267 of ridge 268 in the first panel. In these figures, the card holder is assembled, for example, by moving the first panel 252 in the direction of arrow A.

The embodiment for card holder 240 in FIGS. 10–13*c* is similar to that of card holder 40 in FIG. 6–9*c*, except that the height of ridge 268 is decreased in the second embodiment and a channel 290 is provided in the opposing panel to receive the ridge of lesser height therein. This difference also results in providing different types of panel separation facilitating mechanisms. In the second embodiment of FIGS. 10–13*c*, unlike the first embodiment, the edge of card holder 240 does not have a unitary surface defined along the periphery of the card holder 40. Rather, there is a seam between the two panels running along the entire periphery of the card holder 240.

The upper edge portion of the second panel 254 has a slot 292 therein extending from the edge 284 toward the center of the panel 254. The slot 292 is sized so as to match the slot 270 in the first panel 252 to make gripping the card holder easier, especially when removing the card holder 240 from a flat surface, such as the backing panels 32 and 33 of FIGS. 1–3. A shown in FIGS. 10, 11*a*–11*b*, 12*a*–12*b* and 13*b*, slot 170 extends entirely through the thickness of the first panel 252 and slot 292 extends entirely through the thickness of the second panel 254. When the first and second panels 252 and 254 are in an assembled relationship, slot 270 in the first panel 252 is positioned adjacent slot 292 in the second panel 254 so as to define a cut-out portion 255 in a peripheral edge of card holder 240; the cut-out portion 255 extending through the thickness of card holder 240 thereby providing a gripping portion enabling card holder 240 to be manually grasped by inserting a portion of a finger into cut-out portion 255. See FIG. 10.

Figure 13C:
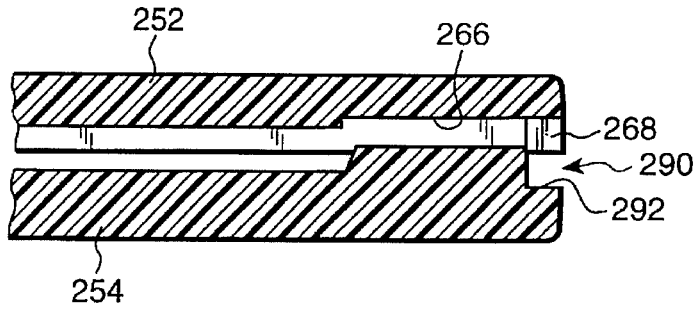
FIG. 13*c* is a partial cross-sectional view of the sports card holder shown in FIG. 11*a* taken along lines 13*c*—13*c* in FIG. 11*a*.

Referring to FIGS. 11*b* and 13*c*, the discontinuity 272 in ridge 268 provides a gap between the interior surface 266 of first panel 152 and surface 292 of channel 290 in the second panel when the two panels are together. The thickness of the gap corresponds to the height of ridge 268. This gap facilitates separation of the two panels 252 and 254, which is accomplished by placing an object, such as a coin or the like, into the gap and prying the two panels part.

Referring to FIG. 13*a*, the second panel 254 includes a pair of grooves 310 on the exposed surface 180 thereof. Grooves 310 are provided to accommodate magnetic strips 311 therein, which are affixed within the grooves by any conventional method, such as glue or the like. See FIG. 12*a*. The magnetic strips 311 enable card holder 240 to be magnetically mounted to the metal backing panels 32 and 33 shown in FIGS. 2*a*–2*b*.

In a further embodiment of the present invention, protuberances 294 are provided along surface 291 of channel 290. Protuberances 294 assist in engaging the inside surface 267 of ridge 268 with the walls of channel 290 so that the panels 252 and 254 are held together more firmly and securely.

In a still further embodiment of the present invention, a friction ridge 296 is provided at the nadir of slot 292. Friction ridge 296 provides a protruding surface from the peripheral edge of card holder 240 at the cutout portion 255 to assist the user in removing the card holder from a flat surface by providing a friction surface for the users finger.

It is to be understood that while the preferred embodiment of the card holder according to the principles of the present invention has been described above, it is contemplated that the various features, such as the pair of slots 270 and 292 and the discontinuities in ridge 268 may be provided at various locations of the panels 252 and 254 other than those described above and illustrated in the Figures.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A card holder for holding and displaying card-like objects, said card holder comprising:

a transparent first panel;

a transparent second panel selectively engaging said first panel;

a protruding portion defined on an interior surface portion of said first panel and a recessed portion defined in an interior surface portion of said second panel, said recessed portion being sized so as to receive a card-like object therein, said protruding portion cooperating with said recessed portion when said first and said second panels are engaged for holding said card-like object within said recessed portion between said first and said second panels;

a securing means for maintaining said first panel and said second panel in an engaged relation; and a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being aligned with said second indentation in said second panel when said first panel and said second panel are engaged so as to define a cut-out portion in a peripheral edge of said card holder, said cut-out portion extending through a thickness of said card holder thereby providing a gripping portion enabling said card holder to be manually grasped by inserting a portion of a finger into said cut-out portion, wherein said first panel and said second panel are sized so that one of said first panel and said second panel fits substantially within the other of said first panel and said second panel when said first panel and said second panel are engaged, wherein said other panel which encompasses said one panel includes a ridge extending from an interior surface thereof so as to define a panel receiving space therein, and wherein said securing means includes a peripheral edge portion of said one panel being encompassed by said other panel and an interior surface portion of said ridge in said other panel encompassing said one panel, said interior surface portion being adjacent said peripheral edge portion when said first panel and said second panel are engaged such that a friction engagement between said first panel and said second panel maintains said first panel and said second panel in an engaged relation.

2. A card holder according to claim 1, further comprising protuberances at one of said peripheral edge portion of said one panel and said interior surface portion of said other panel, said protuberances enhancing said friction engagement therebetween when said first panel and said second panel are engaged.

3. A card holder according to claim 1, wherein said ridge extends along substantially an entirety of a periphery of said other panel associated therewith and is sized so that a distal surface of said ridge is substantially flush with an exposed surface of said one panel when said first panel and said second panel are engaged thereby providing a unitary surface along a periphery of said card holder.

4. A card holder according to claim 3, wherein a discontinuity exists along a portion of said ridge and a protruding portion is defined on an edge of said one panel, said protruding portion being provided within a space defined by said discontinuity when said first panel and said second panel are engaged, said discontinuity and said protruding portion being sized and positioned such that a gap is defined between a surface of said protruding portion and an interior surface of said panel at said discontinuity when said first panel and said second panel are engaged, said gap facilitating separation of said first panel from said second panel by enabling an object to be inserted therein for prying said first panel and said second panel apart.

5. A display system suitable to display and protect card-like objects, said display system comprising:

an expandable display device comprising:

(1) a primary backing panel for receiving thereon at least one card holder, said primary backing panel including top, bottom, first, and second edge portions;

(2) a frame assembly for providing a contiguous border around a periphery of said primary backing panel, said frame assembly including at least one top frame member engaging said top edge portion of said primary backing panel, at least one bottom frame member engaging said bottom edge portion, at least one primary side frame member engaging said first edge portion, and at least one secondary side frame member engaging said second edge portion of said primary backing panel; and a card holder suitable for holding and displaying said card-like object, said card holder comprising:

(1) a transparent first panel;

(2) a transparent second panel selectively engaging said first panel;

(3) a protruding portion defined on an interior surface portion of said first panel and a recessed portion defined in an interior surface portion of said second panel, said recessed portion being sized so as to receive a card-like object therein, said protruding portion cooperating with said recessed portion when said first and said second panels are engaged for holding said card-like object within said recessed portion between said first and said second panels;

(4) a securing means for maintaining said first panel and said second panel in an engaged relation; and (5) a first indentation defined in a peripheral edge of said first panel and a second indentation defined in a peripheral edge of said second panel, said first indentation extending entirely through a thickness of said first panel and said second indentation extending entirely through a thickness of said second panel, said first indentation in said first panel being aligned with said second indentation in said second panel when said first panel and said second panel are engaged so as to define a cut-out portion in a peripheral edge of said card holder, said cut-out portion extending through a thickness of said card holder thereby providing a gripping portion enabling said card holder to be manually grasped by inserting a portion of a finger into said cut-out portion.

6. A card holder according to claim 5, wherein said first panel and said second panel have sizes and shapes that substantially correspond to one another so that a peripheral edge of said first panel is substantially flush with a peripheral edge of said second panel when said first panel and said second panel are engaged, and wherein said securing means includes a channel defined in said interior surface portion of one of said first panel and said second panel, and the other of said first panel and second panel having a ridge defined on said interior surface portion thereof, a portion of said ridge engaging a portion of said channel to maintain said first and said second panels in a surface-to-surface abutting relation due to friction therebetween.

7. A card holder according to claim 6, wherein said ridge extends along a periphery of said one panel and said channel extends along a periphery of said other panel.

8. A card holder according to claim 7, wherein a discontinuity exists along a portion of said ridge so as to define a gap between said first panel and said second panel at portion of a peripheral edge of said card holder at said discontinuity when said first panel and said second panel are engaged, said gap facilitating separation of said first panel from said second panel by enabling an object to be inserted therein for prying said first panel and said second panel apart.

9. A card holder according to claim 5, wherein said first panel and said second panel are sized so that one of said first panel and said second panel fits substantially within the other of said first panel and said second panel when said first panel and said second panel are engaged, wherein said other panel which encompasses said one panel includes a ridge extending from an interior surface thereof so as to define a panel receiving space therein, and wherein said securing means includes a peripheral edge portion of said one panel being encompassed by said other panel and an interior surface portion of said ridge in said other panel encompassing said one panel, said interior surface portion being adjacent said peripheral edge portion when said first panel and said second panel are engaged such that a friction engagement between said first panel and said second panel maintains said first panel and said second panel in an engaged relation.

10. A card holder according to claim 9, further comprising protuberances at one of said peripheral edge portion of said one panel and said interior surface portion of said other panel, said protuberances enhancing said friction engagement therebetween when said first panel and said second panel are engaged.

11. A card holder according to claim 9, wherein said ridge extends along substantially an entirety of a periphery of said other panel associated therewith and is sized so that a distal surface of said ridge is substantially flush with an exposed surface of said one panel when said first panel and said second panel are engaged thereby providing a unitary surface along a periphery of said card holder.

12. A card holder according to claim 11, wherein a discontinuity exists along a portion of said ridge and a protruding portion is defined on an edge of said one panel, said protruding portion being provided within a space defined by said discontinuity when said first panel and said second panel are engaged, said discontinuity and said protruding portion being sized and positioned such that a gap is defined between a surface of said protruding portion and an interior surface of said panel at said discontinuity when said first panel and said second panel are engaged, said gap facilitating separation of said first panel from said second panel by enabling an object to be inserted therein for prying said first panel and said second panel apart.

13. A card holder according to claim 5, further comprising an attachment assembly for securing said card holder to a surface.

14. A card holder according to claim 13, wherein said attachment assembly includes a magnetic fastening device affixed to an exposed surface of one of said first panel and said second panel.

15. A card holder according to claim 5, further comprising a friction ridge at a nadir of said cut-out portion in said peripheral edge of said card holder.

* * * * *